US010787281B2

(12) United States Patent
Iwasa et al.

(10) Patent No.: US 10,787,281 B2
(45) Date of Patent: Sep. 29, 2020

(54) BOXING APPARATUS

(71) Applicant: ISHIDA CO., LTD., Kyoto-shi, Kyoto (JP)

(72) Inventors: Tatsuya Iwasa, Ritto (JP); Yuji Yokota, Ritto (JP); Tatsuya Arimatsu, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 279 days.

(21) Appl. No.: 15/644,827

(22) Filed: Jul. 10, 2017

(65) Prior Publication Data

US 2018/0016041 A1 Jan. 18, 2018

(30) Foreign Application Priority Data

Jul. 12, 2016 (JP) ..... 2016-138041

(51) Int. Cl.
*B65B 5/10* (2006.01)
*B65B 43/59* (2006.01)
(Continued)

(52) U.S. Cl.
CPC ..... *B65B 5/106* (2013.01); *B65B 5/061* (2013.01); *B65B 5/108* (2013.01); *B65B 31/00* (2013.01);
(Continued)

(58) Field of Classification Search
CPC ..... B65B 5/10; B65B 5/061; B65B 5/106; B65B 5/108; B65B 43/56; B65B 43/58; B65B 43/59; B65B 63/02
(Continued)

(56) References Cited

U.S. PATENT DOCUMENTS 3,735,561 A * 5/1973 Wood ..... B65B 5/08 53/245
3,908,539 A * 9/1975 O'Brien ..... B30B 9/301 100/49
(Continued)

FOREIGN PATENT DOCUMENTS

DE 102008010432 A1 8/2009
EP 1035018 A1 9/2000
(Continued)

OTHER PUBLICATIONS

Search Report from the corresponding Patent Application in the Netherlands No. 2019235 dated Apr. 9, 2018.

*Primary Examiner* — Hemant Desai
*Assistant Examiner* — Valentin Neacsu
(74) *Attorney, Agent, or Firm* — Shinjyu Global IP

(57) ABSTRACT

Provided is a boxing apparatus that may repeatedly push products packaged in a soft packaging material into a box through a lateral opening and to pack the products in a plurality of rows, wherein product-filled rate may be easily enhanced without damaging the products. A boxing apparatus 10 may pack a plurality of rows of bagged products into a box. The boxing apparatus may be provided with a push-in mechanism 50, a shutter, a vertical movement mechanism, and a controller 41. The push-in mechanism may push the products into the box through a lateral opening in the box. The shutter may enter and exit the box through the opening. The vertical movement mechanism may move the box and the shutter up and down relative to each other.

5 Claims, 22 Drawing Sheets

(51) Int. Cl.

| | |
|---|---|
| ***B65B 57/10*** | (2006.01) |
| ***B65B 63/02*** | (2006.01) |
| ***B65B 43/58*** | (2006.01) |
| ***B65B 31/00*** | (2006.01) |
| ***B65B 43/26*** | (2006.01) |
| ***B65B 5/06*** | (2006.01) |

(52) U.S. Cl.
CPC ..... *B65B 43/265* (2013.01); *B65B 43/58* (2013.01); *B65B 43/59* (2013.01); *B65B 57/10* (2013.01); *B65B 63/022* (2013.01); *B65B 63/02* (2013.01)

(58) Field of Classification Search
USPC ..... 53/252, 255, 258, 527, 535, 536, 566, 53/244
See application file for complete search history.

(56) References Cited

U.S. PATENT DOCUMENTS

| | | | | | |
|---|---|---|---|---|---|
| 4,608,808 | A * | 9/1986 | Ryan | B65B 5/10 | 414/794.1 |
| 5,063,334 | A * | 11/1991 | Tanita | B25J 9/023 | 318/567 |
| 5,666,786 | A * | 9/1997 | Focke | B65B 5/06 | 53/247 |
| 5,778,640 | A * | 7/1998 | Prakken | B65B 5/061 | 53/244 |
| 6,574,943 | B2 * | 6/2003 | Van Dam | B65B 5/061 | 414/790.3 |
| 8,667,894 | B2 * | 3/2014 | Nissen | B65B 63/02 | 100/35 |
| 8,997,438 | B1 * | 4/2015 | Fallas | B65G 47/914 | 414/222.01 |
| 9,908,652 | B2 * | 3/2018 | Yokota | B65B 43/54 | |
| 2011/0005174 | A1 * | 1/2011 | Prahm | B65B 5/061 | 53/473 |
| 2015/0232219 | A1 * | 8/2015 | Kern | B65B 35/50 | 53/443 |
| 2015/0298842 | A1 * | 10/2015 | Yokota | B65B 43/54 | 53/458 |

FOREIGN PATENT DOCUMENTS

| | | | | |
|---|---|---|---|---|
| EP | 2899129 | A1 | 7/2015 | |
| JP | 2004-15528 | A * | 3/2004 | B65B 5/06 |
| JP | 2004-155428 | A | 6/2004 | |
| JP | 2004155428 | A * | 6/2004 | |

* cited by examiner

BOXING APPARATUS

PRIORITY

This application claims priority under 35 U.S.C. § 119 to Japanese Patent Application No. 2016-138041, filed on Jul. 12, 2016. The entire disclosure of Japanese Patent Application No. 2016-138041 is hereby incorporated herein by reference.

TECHNICAL FIELD

Implementations of the present invention relate to a boxing apparatus, and particularly relates to a boxing apparatus that pushes bags through an opening into a laterally opened box and boxes the bags therein.

BACKGROUND

There may be boxing apparatuses that push bags through an opening into a laterally opened box and box the bags therein.

A boxing apparatus may be configured so as to repeatedly push bags into a laterally opened box, and pack the bags in a plurality of rows. In such a boxing apparatus, a plate-shaped member is moved in through the opening and brought into proximity of a side wall of a box (a side wall that faces the opening and that is on a distal side relative to the opening), and bags in the lower row are compressed between the box and the plate-shaped member, whereby bags in the upper row are easily guided into the box and the filling rate of the box with the bags is enhanced.

SUMMARY

In one boxing apparatus, bags cannot be firmly compressed because there is a possibility of the bags being damaged. Therefore, in such a boxing apparatus, extra space is likely to be left in the boxes, and there is room for improvement in the filling rate of the boxes with the bags.

A problem may occur where a boxing apparatus repeatedly pushes products packaged in a soft packaging material into a box through a side opening and packs the products in a plurality of rows, wherein the filling rate in the box with products can be enhanced without damaging the products.

A boxing apparatus according to a first aspect of the present invention packs a plurality of rows of products each packaged in a soft packaging material into a box. The boxing apparatus includes a pusher, a plate-shaped member, a vertical movement mechanism, and a controller. The pusher repeatedly pushes the products into the box through a lateral opening of the box. The plate-shaped member enters and exits the box through the lateral opening. The vertical movement mechanism moves the box and the plate-shaped member up and down relative to each other. The controller causes the plate-shaped member to enter the box, and actuates the vertical movement mechanism to compress the products inside the box. The controller has an entry amount changing unit to change an amount by which the plate-shaped member enters the box when compressing the products inside the box.

When, as is the case with a certain boxing apparatus, the plate-shaped member and the box are moved relative to each other to compress the products while entering the plate-shaped member to a vicinity of a side wall on a distal side from the lateral opening, there is very little space for the compressed soft packaging material to deform and escape (deform and spread out). Therefore, the soft packaging material is likely to be damaged when the products are compressed.

As a countermeasure, in the boxing apparatus according to the first aspect of the present invention, the amount by which the plate-shaped member enters the box can be changed, and a space for the soft packaging material to deform and escape can be ensured by changing the entry amount of the plate-shaped member smaller. In other words, the deformed soft packaging material can spread out from a gap between the plate-shaped member and the box into a space above the plate-shaped member due to reducing the entry amount of the plate-shaped member. Accordingly, damage to the soft packaging material can be prevented. Even when the entry amount of the plate-shaped member is small, the products inside the box are compressed by the plate-shaped member in proximity to the lateral opening, and a space for the products pushed next by the pusher to enter into the box can therefore be ensured. Therefore, a product-filled rate (a percentage of a volume of space in the box occupied by the products packaged in the soft packaging material) can be improved even when the entry amount of the plate-shaped member is small.

A boxing apparatus according to a second aspect of the present invention is the boxing apparatus according to the first aspect, wherein at least when the products in the box are compressed before the last row of products of the plurality of rows is pushed in by the pusher, the entry amount changing unit changes the amount by which the plate-shaped member enters the box to 70% or less of a length of the box in a direction that the products are pushed in by the pusher.

Immediately before the last row of products is pushed into the box, the box has already been packed with a large number of products, and the product-filled rate is comparatively high. Therefore, the soft packaging material is likely to be damaged, particularly when the uppermost row of products (the second-to-last row of the plurality of rows) in the box is compressed.

However, in the boxing apparatus according to the second aspect of the present invention, at least immediately before the last row of products is pushed in, the entry amount of the plate-shaped member during product compression is suppressed to 70% or less of the length of the box in the product push-in direction, and damage to the soft packaging material is therefore readily prevented.

A boxing apparatus according to a third aspect of the present invention is the boxing apparatus according to the first or second aspect, wherein at least when the products in the box are compressed before the last row of products of the plurality of rows is pushed in by the pusher, the entry amount changing unit changes the amount by which the plate-shaped member enters the box so that a distance from an end part of the plate-shaped member on a downstream side in the direction that the products are pushed in by the pusher to a wall of the box that faces the lateral opening is 30% or more of a length of the products in the direction that the products are pushed in by the pusher.

In the boxing apparatus according to the third aspect of the present invention, at least immediately before the last row of products is pushed in, the entry amount of the plate-shaped member is changed so that the distance between a distal end of the plate-shaped member and the wall facing the lateral opening is 30% or more of the product length in the product push-in direction. Therefore, damage to the soft packaging material is readily prevented even during product compression before the pushing in of the last row of products during which the soft packaging material is readily damaged.

A boxing apparatus according to a fourth aspect of the present invention is the boxing apparatus according to any of the first through third aspects, wherein the boxing apparatus packs three or more rows of products into the box. The entry amount changing unit changes the amount by which the plate-shaped member enters the box so that a first entry amount is less than a second entry amount. The first entry amount is an amount by which the plate-shaped member enters the box when compressing the products in the box before the pusher pushes in the last row of the plurality of rows of products. The second entry amount is an average of the amounts by which the plate-shaped member enters the box when compressing the products in the box before the pusher pushes in second through second-to-last rows of the plurality of rows of products.

The expression "second through second-to-last rows" includes cases of the second row alone. Specifically, in the case of the boxing apparatus being an apparatus that packs three rows of products into the box, the expression "second through second-to-last rows" represents the second row alone.

In the boxing apparatus according to the fourth aspect of the present invention, the entry amount (the first entry amount) of the plate-shaped member when the products are compressed immediately before the last row of products is pushed in is less than the average (the second entry amount) of the entry amounts of the plate-shaped member during the preceding product compressions. Therefore, damage to the soft packaging material is readily prevented even during product compression before the last row of products is pushed in, during which the soft packaging material is readily damaged.

With this configuration, when the products are compressed at times other than before the last row of products is pushed in (before the second through second-to-last rows of products are pushed in), the products are readily compressed firmly by the plate-shaped member, and it is easy to improve the product-filled rate.

A boxing apparatus according to a fifth aspect of the present invention is the boxing apparatus according to any of the second through fourth aspects, wherein the controller further has a movement amount changing unit. The movement amount changing unit changes a relative movement amount between the box and the plate-shaped member caused by the vertical movement mechanism when compressing the products in the box. The movement amount changing unit changes the relative movement amount between the box and the plate-shaped member caused by the vertical movement mechanism so that a first relative movement amount is greater than a second relative movement amount. The first relative movement amount is a relative movement amount between the box and the plate-shaped member caused by the vertical movement mechanism when compressing the products in the box before the pusher pushes in the last row of the plurality of rows of products. The second relative movement amount is an average of the relative movement amounts between the box and the plate-shaped member caused by the vertical movement mechanism when compressing the products in the box before the pusher pushes in the second through second-to-last rows of the plurality of rows of products.

Immediately before the last row of products is pushed into the box, the box has already been filled with a large number of products, the product-filled rate is comparatively high, and it is therefore generally difficult to sufficiently ensure space for pushing the products into the box.

In the boxing apparatus according to the fifth aspect of the present invention, a particularly large relative movement amount between the box and the plate-shaped member can be achieved immediately before the last row of products is pushed into the box, and it is therefore easy to ensure space to push in the products (space where the products pushed in by the pusher enter the box). With the present boxing apparatus, as the entry amount of the plate-shaped member is suppressed to a small amount when the products are compressed immediately before the last row of products is pushed in, damage to the soft packaging material is readily prevented even when the relative movement amount between the box and the plate-shaped member is large.

A boxing apparatus according to a sixth aspect of the present invention is the boxing apparatus according to any of the first through fifth aspects, further includes a holding section to hold the box. The vertical movement mechanism moves the holding section up and down.

In this boxing apparatus, in order for a plurality of rows of products to be packed, the box and a position where the products are pushed in by the pusher are moved up and down relative to each other when the products are pushed in. Further, in this boxing apparatus, the box and the plate-shaped member are moved up and down relative to each other in order to compress the products in the box.

In the boxing apparatus according to the sixth aspect of the present invention, the vertical movement mechanism moves the holding section for the box (i.e., the box) up and down. Therefore, the same vertical movement mechanism can be utilized to move the product push-in position and the box up and down relative to each other and to move the box and the plate-shaped member up and down relative to each other when the products are pushed in and when the products in the box are compressed. The structure of the apparatus can therefore be made simpler than in cases in which both the product push-in position and the plate-shaped member are moved.

In the boxing apparatus according to an implementation of the present invention, the amount by which the plate-shaped member enters the box can be changed, and a space for the soft packaging material to deform and escape can be ensured by changing the entry amount of the plate-shaped member smaller. In other words, the deformed soft packaging material can spread out from the gap between the plate-shaped member and the box into the space above the plate-shaped member due to reducing the entry amount of the plate-shaped member. Accordingly, damage to the soft packaging material can be prevented. Even when the entry amount of the plate-shaped member is small, the products inside the box are compressed by the plate-shaped member in proximity to the lateral opening. Therefore, the space for the products pushed next by the pusher to enter into the box can be ensured, and the product-filled rate can be improved.

BRIEF DESCRIPTION OF THE DRAWINGS

FIG. 3A shows a view of the bag from a main surface side and FIG. 3B shows a view of the bag from a side surface side (a side orthogonal to the main surface);

FIG. 8A depicts the products placed on the conveyor belt with the main surfaces of the bags either facing the conveyor belt or facing the opposite direction from the conveyor belt. FIG. 8B depicts the products placed on the conveyor belt with the main surfaces of the bags facing either to the right or to the left. FIG. 8C depicts the products placed on the conveyor belt with the main surfaces of the bags tilted.

DETAILED DESCRIPTION

Figure 1:
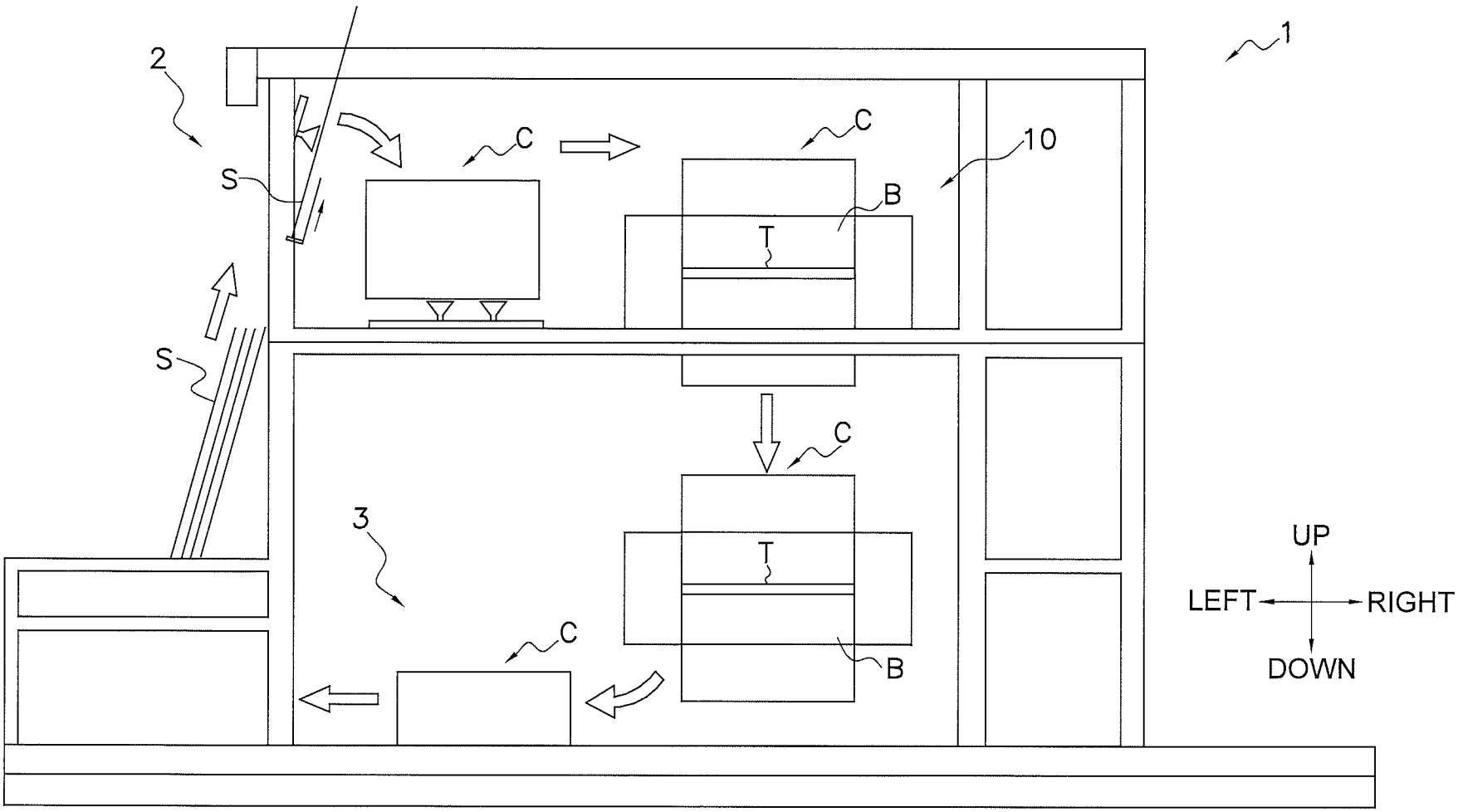
FIG. 1 is a schematic front view of a box-making/boxing system including a boxing apparatus according to an implementation of the present invention.

A boxing apparatus 10 according to one implementation of the present invention is described with reference to the drawings. The following implementation is a specific example of the present invention and is not intended to limit the technical scope of the present invention.

In the following description, the words up, down, left, right, front (front surface), rear (back surface), and other terms may be used in order to describe directions and/or positions. These terms conform to up, down, left, right front, and rear indicated with arrows in the drawings, unless otherwise specified. In the following description, the words parallel, orthogonal, horizontal, vertical, and other terms may be used in order to describe directions, positional relationships, and/or the like, and these include not only cases of being strictly parallel, orthogonal, horizontal, vertical, etc., but also cases of being substantially parallel, orthogonal, horizontal, vertical, etc.

(1) Overall Summary

First, a box-making/boxing system 1 including the boxing apparatus 10 is described.

The box-making/boxing system 1 is an apparatus that forms corrugated cardboard boxes C from corrugated cardboard sheets S, and fills the formed corrugated cardboard boxes C with products packaged in a soft packaging material serving as a boxed object. The products are not limited, but are, e.g., snack foods accommodated in bags A.

Figure 3A:
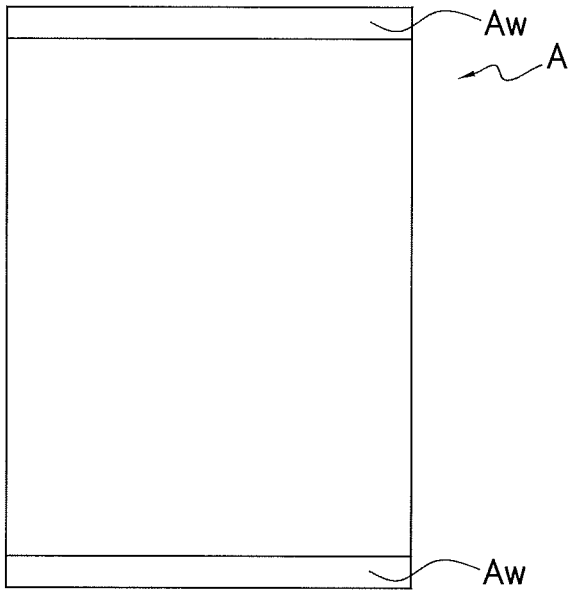
FIG. 3A and FIG. 3B show specific examples of a bag to accommodate a product boxed by the boxing apparatus of FIG. 1.
Figure 3B:
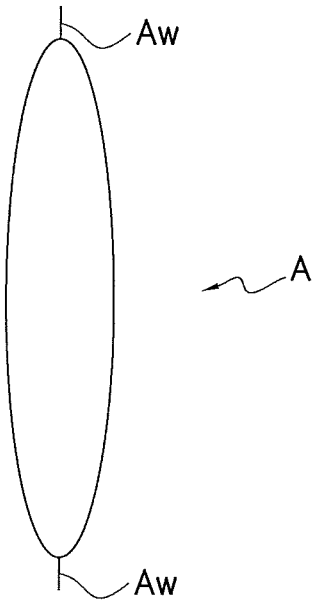

The bags A are not limited, but are bags formed by closing the tops and bottoms of sheets formed into cylinders with lateral seals Aw (see FIG. 3A and FIG. 3B). Though not limited, the bags A are flat bags formed into rectangle shapes (see FIG. 3A and FIG. 3B). The material of the bags A accommodating the products is not limited, but is, a flexible and deformable material such as polypropylene, polyethylene, and paper.

Figure 4:
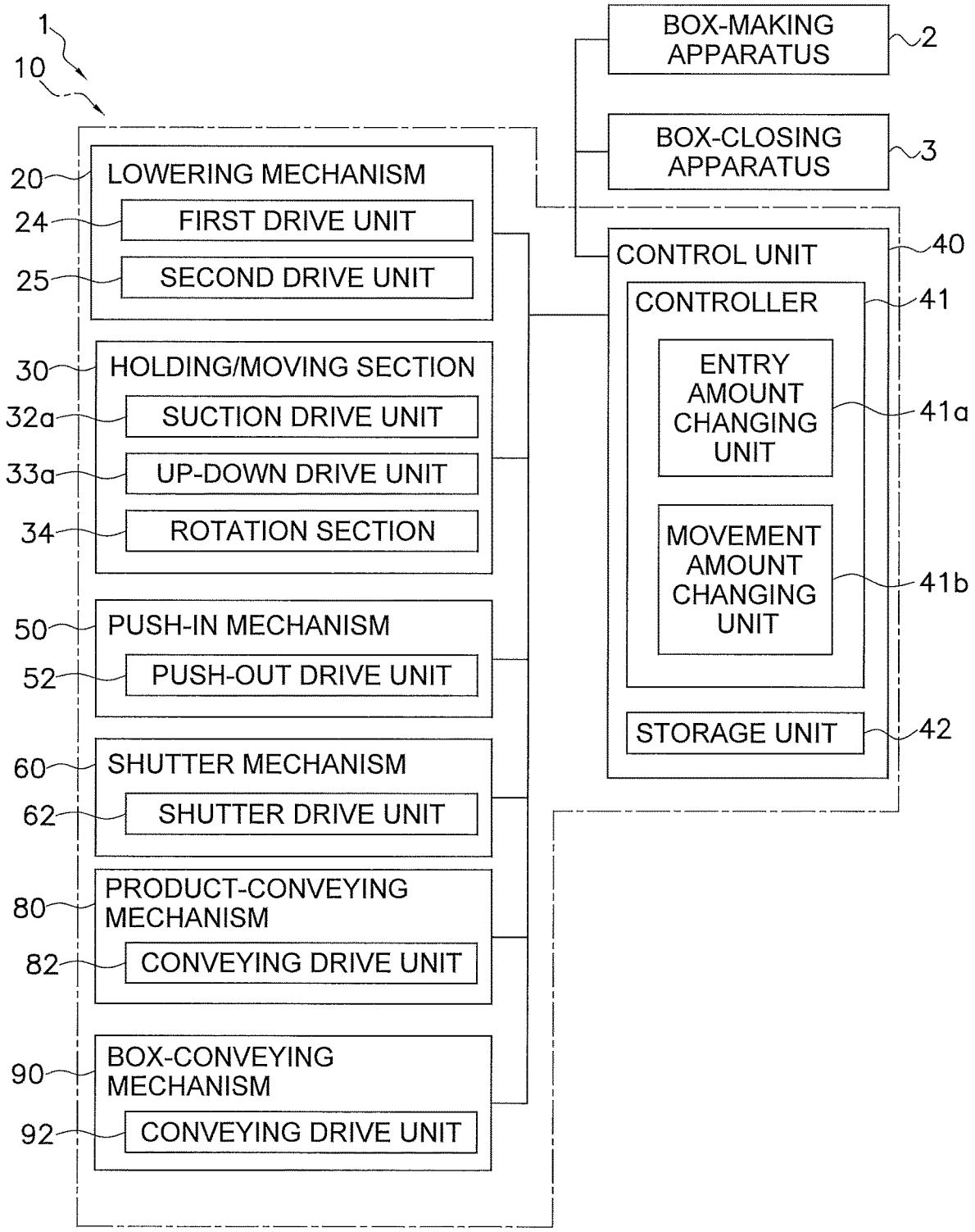
FIG. 4 is a block diagram of the box-making/boxing system of FIG. 1.

The box-making/boxing system 1 mainly includes a box-making apparatus 2, the boxing apparatus 10, a box-closing apparatus 3, and a control unit 40 (see FIGS. 1 and 4).

The box-making apparatus 2 opens (unfolds) the corrugated cardboard sheet S (the corrugated cardboard boxes C in a folded up state), closes bottom lids B of the corrugated cardboard boxes C, and tapes up the bottom lids B with tape T to make the corrugated cardboard boxes C that are open only on one side (only on the upper lid side) (see FIG. 1). The method of forming the bottom lids B is exemplified and is not limited to the method described above. For example, the box-making apparatus 2 may form the bottom lids B by "interleaved folding" so that flaps C2 (see FIG. 2) of the corrugated cardboard box C overlap flaps C2 that are mutually adjacent. The corrugated cardboard boxes C made in the box-making apparatus 2 are conveyed to the boxing apparatus 10 by a conveyor (not shown) (see FIG. 1). The box-making apparatus 2 sends the manufactured corrugated cardboard boxes C one after another to the boxing apparatus 10.

The conveyor (not shown) of the box-making apparatus 2 supplies the boxing apparatus 10 with the corrugated cardboard boxes C having openings Op (see FIG. 7A) facing laterally. Specifically, the conveyor (not shown) of the box-making apparatus 2 supplies the corrugated cardboard boxes C to the boxing apparatus 10 such that the bottom lids B are disposed on a front surface side of the box-making/boxing system 1 and the openings Op (the unclosed upper lid sides) are disposed on a back surface side of the box-making/boxing system 1. In other words, the conveyor of the box-making apparatus 2 supplies the corrugated cardboard boxes C, in which the openings Op face rearward, to the boxing apparatus 10.

Figure 2:
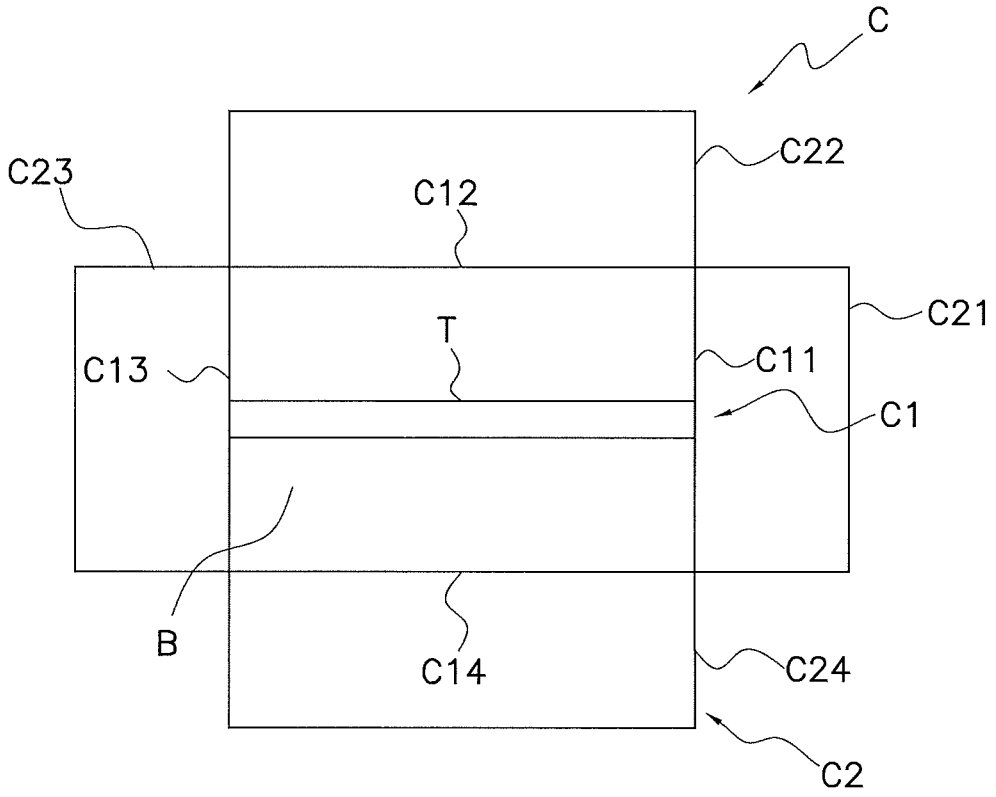
FIG. 2 is a view from a closed bottom lid side of a corrugated cardboard box used for packing products in the boxing apparatus of FIG. 1, flaps on an upper lid side (opening side) being opened outward.

The corrugated cardboard boxes C used in the box-making/boxing system 1 include side surface parts C1 formed into annular shapes having four side surface parts C11 to C14, and a total of eight tabular shaped flaps C2 extending from the four side surface parts C11 to C14, as seen in FIG. 2.

At the point in time when the boxes are delivered to the boxing apparatus 10, the flaps C2 on the front surface side of the box-making/boxing system 1 are closed by the box-making apparatus 2, and the bottom lids B are formed as seen in FIG. 1. When the boxes are supplied to the boxing apparatus 10, flaps C21 to C24 (C2) on the back surface side of the box-making/boxing system 1 are open outward. In other words, when supplied to the boxing apparatus 10, the corrugated cardboard boxes C have the openings Op facing rearward. The corrugated cardboard box C is supplied to the boxing apparatus 10 in a state that the side surface part C14 faces downward as seen in FIG. 2.

The boxing apparatus 10 packs a plurality of rows of products packaged in the bags A into the corrugated cardboard boxes C which face their openings Op laterally. In other words, the boxing apparatus 10 packs products on top of products that have already packed into the corrugated cardboard boxes C. In this implementation, the boxing apparatus 10 packs four rows of products packaged in the bags A into the corrugated cardboard boxes C which face their openings Op laterally (see FIG. 7L). The number of rows of products packed by the boxing apparatus 10 is exemplified and is not limited to the number in this implementation. For example, the number of rows of products packed by the boxing apparatus 10 may be two, three, five or more.

Figure 7A:
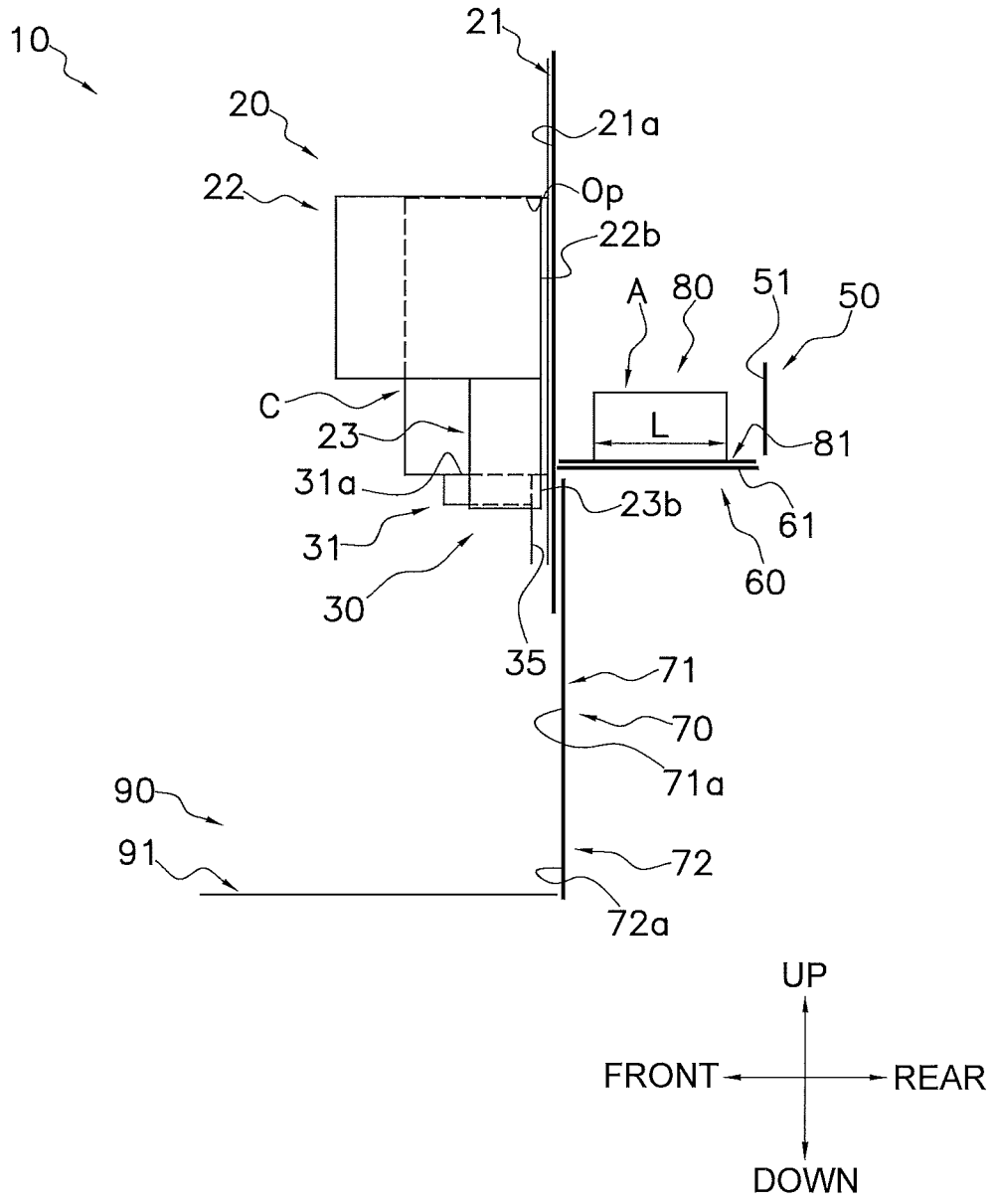
FIG. 7A is a view for illustrating an action of the boxing apparatus of FIG. 1, the view being from a right side of the boxing apparatus and depicting a state in which a holding/moving section is holding the corrugated cardboard box which has been lowered from above and the opening of which faces rearward.

The boxing apparatus 10 mainly has a lowering mechanism 20, a holding/moving section 30, a push-in mechanism 50, a shutter mechanism 60, a spill prevention mechanism 70, a product-conveying mechanism 80, and a box-conveying mechanism 90 (see FIG. 7A).

The lowering mechanism 20 lowers each of the corrugated cardboard boxes C which is delivered from the box-making apparatus 2, and of which the side surface part C14 faces downward and the opening Op faces rearward. The corrugated cardboard boxes C lowered by the lowering mechanism 20 fall onto a support surface 31*a* (see FIG. 7) of a holding section 31 of the holding/moving section 30, described hereinafter. The corrugated cardboard boxes C lowered onto the support surface 31*a* are moved rearward to a product filling location by at least one of a second guide member 22 and a third guide member 23 of the lowering mechanism 20, described hereinafter.

In this implementation, the product filling location is adjacent to the product-conveying mechanism 80 in a forward-backward direction, as seen in FIG. 7A. The term "product filling location" also means a location where the corrugated cardboard boxes C are filled with the products when the boxing apparatus 10 is viewed from above. The corrugated cardboard boxes C are moved in an up-down direction by the holding/moving section 30 in the product filling location, and are thereby moved to a height position (product push-in position) where the products are pushed in by the push-in mechanism 50.

In this implementation, the lowering mechanism 20 lowers the corrugated cardboard boxes C onto the support surface 31*a* of the holding section 31 of the holding/moving section 30, but this arrangement is not provided by way of limitation. For example, the lowering mechanism 20 may lower the corrugated cardboard boxes C onto a receiving/holding member which temporarily holds the corrugated cardboard boxes C and is not the holding section 31 of the holding/moving section 30. The boxing apparatus 10 may be configured so that the receiving/holding member, having received the corrugated cardboard boxes C, holds the corrugated cardboard boxes C until the holding section 31 of the holding/moving section 30 holds the corrugated cardboard boxes C.

The holding/moving section 30 receives the corrugated cardboard boxes C lowered from above by the lowering mechanism 20. The holding/moving section 30 also holds the corrugated cardboard boxes C that have been horizontally moved to the product filling location by the lowering mechanism 20, and moves the corrugated cardboard boxes C in the up-down direction. The holding/moving section 30 moves the corrugated cardboard boxes C in the up-down direction to the product push-in position and then holds them in the product push-in position when the push-in mechanism 50 pushes in the products. The holding/moving section 30 also moves the corrugated cardboard boxes C filled with the products onto a conveyor belt 91 of the box-conveying mechanism 90, described hereinafter.

The push-in mechanism 50 pushes the products into the corrugated cardboard boxes C held by the holding/moving section 30 through the openings Op (lateral openings) of the corrugated cardboard boxes C. The push-in mechanism 50 repeatedly pushes the products into each of the corrugated cardboard boxes C through the opening Op of the corrugated cardboard box C, and packs the plurality of rows of products packaged in the bags A into the corrugated cardboard box C.

The spill prevention mechanism 70 prevents spilling of the products in the corrugated cardboard boxes C from the openings Op of the corrugated cardboard boxes C.

The box-conveying mechanism 90 conveys to the box-closing apparatus 3 the corrugated cardboard boxes C which have been placed on the conveyor belt 91 by the holding/moving section 30 and of which the openings Op face upward.

The box-closing apparatus 3 forms upper lids by closing the flaps C2 (flaps C21 to C24) of the corrugated cardboard boxes C which have been conveyed from the box-conveying mechanism 90 and of which the openings Op face upward, and the box-closing apparatus 3 tapes up the closed upper lids. The corrugated cardboard boxes C with the upper lids closed by the box-closing apparatus 3 are carried out of the box-making/boxing system 1.

The control unit 40 configures part of the boxing apparatus 10. The control unit 40 is electrically connected with various configurations of the boxing apparatus 10 as seen in FIG. 4, and the control unit 40 controls actions of the various configurations of the boxing apparatus 10. The control unit 40 is also electrically connected with the various configurations of the box-making apparatus 2 and the box-closing apparatus 3, and the control unit 40 controls actions of the various configurations of the box-making apparatus 2 and the box-closing apparatus 3. In this implementation, the control unit 40 controls all actions of the box-making apparatus 2, the boxing apparatus 10, and the box-closing apparatus 3, but this arrangement is not provided by way of limitation. The box-making/boxing system 1 may have a control unit to control the actions of the box-making apparatus 2 and the box-closing apparatus 3 which is separate from the control unit 40.

(2) Detailed Configuration

The details of the boxing apparatus 10 (including the control unit 40) are described below.

(2-1) Lowering Mechanism

The lowering mechanism 20 lowers the corrugated cardboard boxes C, which are supplied from the box-making apparatus 2 and which face their openings Op laterally (rearward), onto the support surface 31*a* of the holding section 31 of the holding/moving section 30, hereinafter-described, such that the flaps C2 adjacent to the openings Op are open outward and the side surface parts C14 face downward. The lowering mechanism 20 also moves the corrugated cardboard boxes C, which have been lowered onto the support surface 31*a* of the holding section 31, horizontally rearward as seen in a plan view to the product filling location (the location adjacent to the product-conveying mechanism 80 as seen in a plan view). Furthermore, the lowering mechanism 20 regulates the horizontal movement of the corrugated cardboard boxes C when the products are loaded into the corrugated cardboard boxes C.

Figure 5:
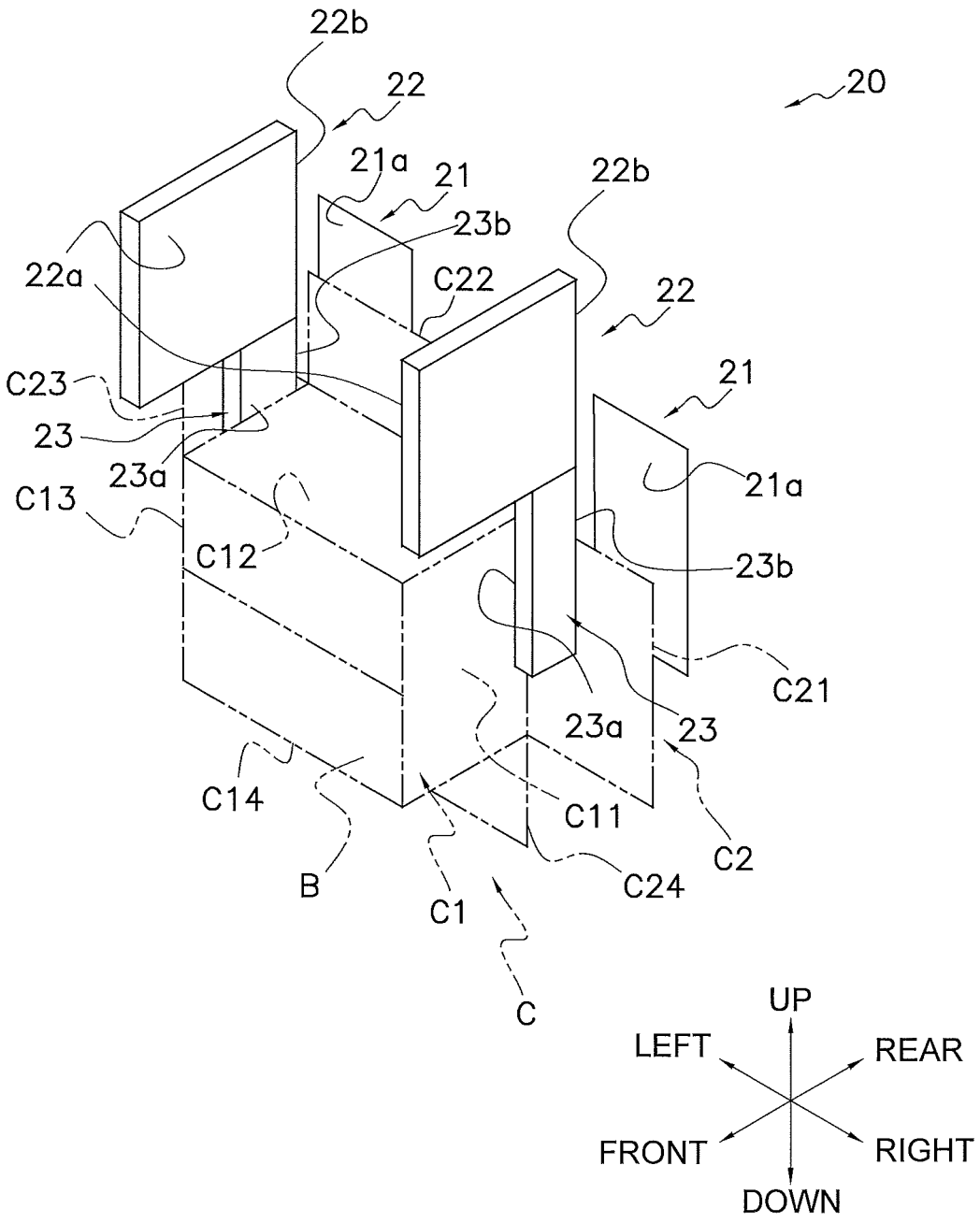
FIG. 5 is a schematic perspective view for illustrating a lowering mechanism of the box-making/boxing system of FIG. 1.

The lowering mechanism 20 mainly has a pair of first guide members 21, a pair of second guide members 22, a pair of third guide members 23, a first drive unit 24, and a second drive unit 25 (see FIGS. 4, 5, and 7A).

The first guide members 21 have, on the front surface sides, guide surfaces 21*a* that spread in the up-down direction and a left-right direction (see FIG. 5). When the corrugated cardboard box C is lowered, the first guide members 21 guide the outwardly opened flaps C2 of the lowered corrugated cardboard box C. In other words, when the corrugated cardboard box C is lowered, the first guide members 21 regulate the horizontal movement of the outwardly opened flaps C2 of the lowered corrugated cardboard box C.

One of the pair of the first guide members 21 (the first guide member 21 that is disposed on the left side) is disposed to the rear of the flap C23 of the lowered corrugated cardboard box C so that the guide surface 21*a* faces the flap C23 of the lowered corrugated cardboard box C (see FIG. 5). The other of the pair of first guide members 21 (the first guide member 21 that is disposed on the right side) is disposed to the rear of the flap C21 of the lowered corrugated cardboard box C so that the guide surface 21*a* faces the flap C21 of the lowered corrugated cardboard box C (see FIG. 5). The guide surface 21*a* of the first guide member 21 facing the flap C21 also faces part of the flap C22 of the lowered corrugated cardboard box C.

When the corrugated cardboard box C is lowered, the second guide members 22 guide the side surface parts C1 and the outwardly opened flaps C2 of the lowered corrugated cardboard box C. In other words, when the corrugated cardboard box C is lowered, the second guide members 22 regulate the horizontal movement of the side surface parts C1 and the outwardly opened flaps C2 of the lowered corrugated cardboard box C.

One of the pair of second guide members 22 is disposed to the left of the lowered corrugated cardboard box C. The second guide member 22 disposed to the left of the lowered corrugated cardboard box C has on the right side a guide surface 22*a* that faces the side surface part C13 of the lowered corrugated cardboard box C, and has on the back surface side a guide surface 22*b* that faces the flap C23 of the lowered corrugated cardboard box C (see FIG. 5). The other of the pair of second guide members 22 is disposed to the right of the lowered corrugated cardboard box C. The second guide member 22 disposed to the right of the lowered corrugated cardboard box C has on the left side a guide surface 22*a* that faces the side surface part C11 of the lowered corrugated cardboard box C, and has on the back surface side a guide surface 22*b* that faces the flap C21 of the lowered corrugated cardboard box C (see FIG. 5).

The third guide members 23, when in a first state described hereinafter, are provided below each of the second guide members 22 so as to extend downward from lower ends of the second guide members 22. When the corrugated cardboard box C is lowered, the third guide members 23 guide the side surface parts C1 and the outwardly opened flaps C2 of the lowered corrugated cardboard box C. In other words, when the corrugated cardboard box C is lowered, the third guide members 23 regulate the horizontal movement of the side surface parts C1 and the outwardly opened flaps C2 of the lowered corrugated cardboard box C. The third guide members 23 are configured so as to be able to turn about a rotational shaft extending in the forward-backward direction and disposed in proximity to the lower ends of the second guide members 22.

Of the pair of third guide members 23, the third guide member 23 disposed to the left of the lowered corrugated cardboard box C has on the right side a guide surface 23*a* facing the side surface part C13 of the lowered corrugated cardboard box C, and has on the back surface side a guide surface 23*b* facing the flap C23 of the lowered corrugated cardboard box C (see FIG. 5). The third guide member 23 disposed to the right of the lowered corrugated cardboard box C has on the left side a guide surface 23*a* facing the side surface part C11 of the lowered corrugated cardboard box C, and has on the back surface side a guide surface 23*b* facing the flap C21 of the lowered corrugated cardboard box C (see FIG. 5).

With the third guide members 23 in the first state described hereinafter, the guide surfaces 23*a* of the third guide members 23 spread continuously with the guide surfaces 22*a* of the second guide members 22 disposed above the third guide members 23 (see FIG. 5). In other words, with the third guide members 23 in the first state described hereinafter, the guide surface 23*a* of each of the third guide members 23 and the guide surface 22*a* of the second guide member 22 disposed above the third guide member 23 are disposed in the same (virtual) plane. Additionally, with the third guide members 23 in the first state described hereinafter, the guide surface 23*b* of the third guide member 23 spreads continuously with the guide surface 22*b* of the second guide member 22 disposed above the third guide member 23 (see FIG. 5). In other words, with the third guide members 23 in the first state described hereinafter, the guide surface 23*b* of each of the third guide members 23 and the guide surface 22*b* of the second guide member 22 disposed above the third guide member 23 are disposed in the same (virtual) plane.

The lowering mechanism 20 lowers the corrugated cardboard box C so that a main body of the corrugated cardboard box C (a portion that is enclosed by the side surface parts C1 and the bottom lids B and that accommodates the products) passes between the guide surfaces 22*a* of the pair of second guide members 22 and between the guide surfaces 23*a* of the pair of third guide members 23. The lowering mechanism 20 also lowers the corrugated cardboard box C so that the flaps C21, C23 of the corrugated cardboard box C pass between the guide surfaces 21*a* of the first guide members 21, and both the guide surfaces 22*b* of the second guide members 22 and the guide surfaces 23*b* of the third guide members 23, which face the guide surfaces 21*a*. Due to such a configuration, the side surface parts C11, C13 of the corrugated cardboard box C are guided by the guide surfaces 22*a* and the guide surfaces 23*a*, and the flaps C21, C23 of the corrugated cardboard box C are guided by the guide surfaces 21*a*, the guide surfaces 22*b*, and the guide surfaces 23*b*. Additionally, the flaps C22 of the corrugated cardboard box C are held in an outwardly opened state by the guide surfaces 21*a*. As a result, the corrugated cardboard box C is lowered while in a predetermined orientation to a predetermined position on the support surface 31*a* of the holding section 31 of the holding/moving section 30. Additionally, the flaps C2 on the opening Op side (the upper lid side) of the corrugated cardboard box C are held open.

At least one of the second guide members 22 and the third guide members 23 have a function of moving the corrugated cardboard box C rearward to the product filling location after the corrugated cardboard box C has been lowered onto the support surface 31*a* of the holding section 31 of the holding/moving section 30. This function is specifically described.

The second guide members 22 and the third guide members 23 are configured so as to be driven in the forward-backward direction by the first drive unit 24. The first drive unit 24 is an air cylinder which drives the second guide members 22 and the third guide members 23 in the forward-backward direction. The air cylinder is one example of the first drive unit 24, but is not provided by way of limitation. For example, the first drive unit 24 may be a motor or the like.

While the corrugated cardboard box C is being lowered, the guide surfaces 21*a* of the first guide members 21, and the guide surfaces 22*b* of the second guide members 22 and the guide surfaces 23*b* of the third guide members 23, are disposed comparatively far away from each other. The purpose of such a configuration is to prevent the flaps C2 of the lowered corrugated cardboard box C from being caught between the first guide members 21, and the second guide members 22 and the third guide members 23. After the corrugated cardboard box C has been lowered, the second guide members 22 and the third guide members 23 are moved rearward by the first drive unit 24 so as to approach the first guide members 21. At this time, at least one of the guide surfaces 22*b* of the second guide members 22 and the guide surfaces 23*b* of the third guide members 23 push the front-side surfaces of the flaps C21, C23 of the corrugated cardboard box C on the support surface 31*a* of the holding section 31, and move the corrugated cardboard box C rearward to a location (the product filling location) being adjacent to the product-conveying mechanism 80 as seen in a plan view.

After at least one of the second guide members 22 and the third guide members 23 have moved the corrugated cardboard box C to the product filling location, the flap C21 and the flap C23 are held between the guide surfaces 21*a* of the first guide members 21, and at least one of the guide surfaces 22*b* of the second guide members 22 and the guide surfaces 23*b* of the third guide members 23 until the filling of the corrugated cardboard box C with the products is complete. When the products are loaded into the corrugated cardboard box C, the horizontal (mainly in the forward-backward direction) movement of the flap C21 and the flap C23 is regulated and the horizontal movement of the corrugated cardboard box C is prevented.

The corrugated cardboard box C is moved in the up-down direction by the holding/moving section 30 in the location (the product filling location) being adjacent to the product-conveying mechanism 80 as seen in a plan view, as is described later. Therefore, a distance between the guide surfaces 21*a* of the first guide members 21 and the guide surfaces 22*b* of the second guide members 22, and a distance between the guide surfaces 21*a* of the first guide members 21 and the guide surfaces 23*b* of the third guide members 23, are set to distances that allow the flap C21 and the flap C23 to freely move vertically.

The third guide members 23 are configured so as to be driven by the second drive unit 25 and be capable of turning clockwise or counterclockwise around the rotational shaft that extends in the forward-backward direction and that is disposed near the lower ends of the second guide members 22. The second drive unit 25 is not limited but is, e.g., an air cylinder.

The state of the third guide members 23 is switchable between a first state and a second state by turning the second drive unit 25. The first state of the third guide members 23 is a state in which the guide surfaces 23*a* of the third guide members 23 and the guide surfaces 22*a* of the second guide members 22 are disposed substantially in the same plane. The second state of the third guide members 23 is a state where a plane on which the guide surfaces 23*a* of the third guide members 23 are disposed and a plane on which the guide surfaces 22*a* of the second guide members 22 are disposed so as to intersect (more specifically, are orthogonal). In the second state, the left-side third guide member 23 is disposed so as to extend leftward from near the lower end of the second guide member 22 on the left side. Additionally, in the second state, the right-side third guide member 23 is disposed so as to extend rightward from near the lower end of the second guide member 22 on the right side. The timing at which the third guide members 23 are switched between the first state and the second state is described hereinafter.

(2-2) Holding/Moving Section

The holding/moving section 30 receives the rearward-opened corrugated cardboard box C lowered from above by the lowering mechanism 20. Additionally, the holding/moving section 30 holds the corrugated cardboard box C, which has been moved to the product filling location by the lowering mechanism 20, in a state that the opening Op faces laterally. Specifically, the holding section 31 of the holding/moving section 30 holds the corrugated cardboard box C, which has been moved to the product filling location by the lowering mechanism 20, in a state that the opening Op faces laterally. Additionally, the holding/moving section 30 moves the holding section 31 up and down, thereby moving the corrugated cardboard box C, which has been moved to the product filling location by the lowering mechanism 20, in the up-down direction. Additionally, the holding/moving section 30 moves the corrugated cardboard box C filled with the products from the product filling location onto the conveyor belt 91 of the box-conveying mechanism 90, described hereinafter.

Figure 6:
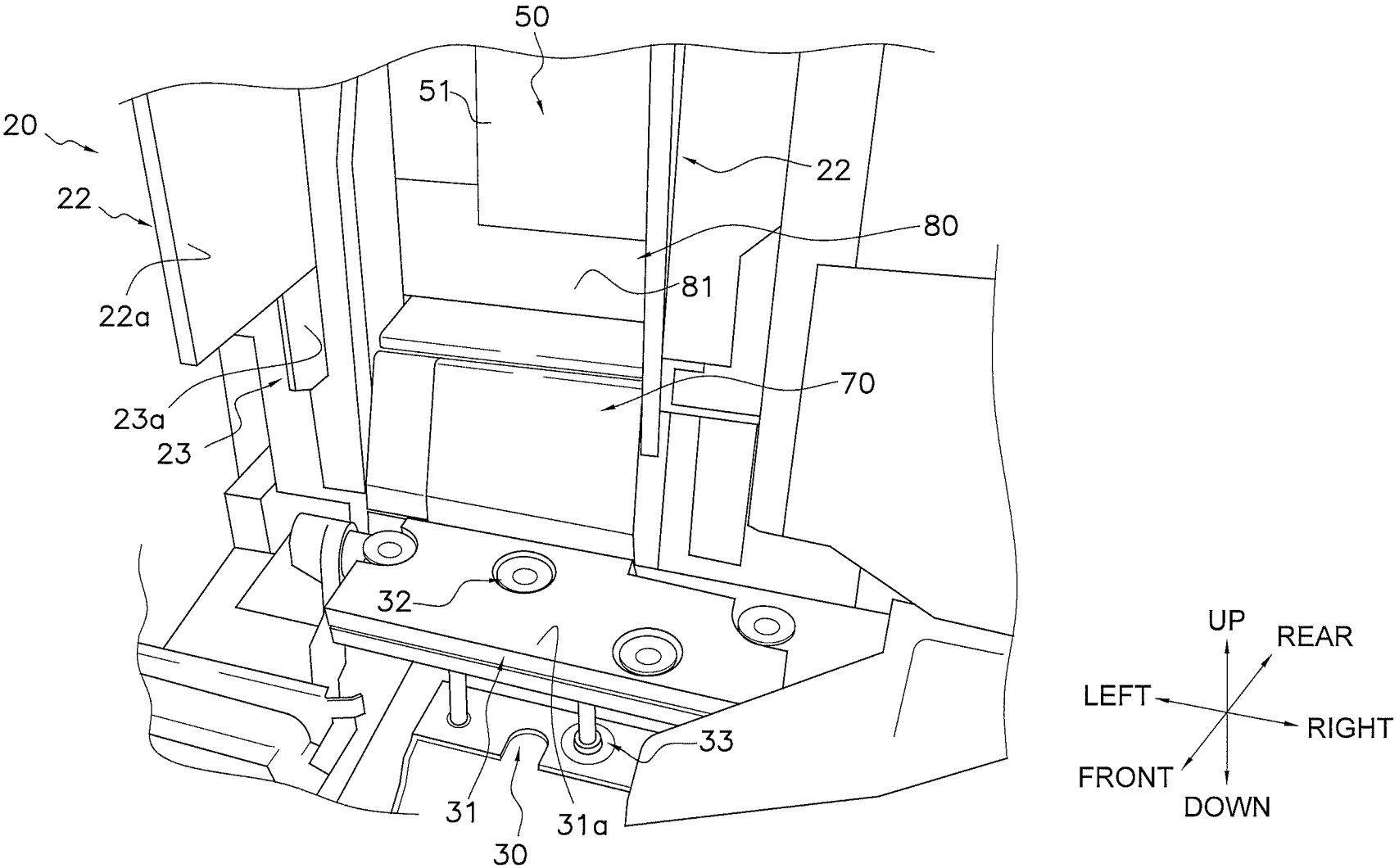
FIG. 6 is a schematic perspective view depicting a vicinity of a product push-in location of the boxing apparatus of FIG. 1.

The holding/moving section 30 mainly has the holding section 31, a vertical movement mechanism 33, and a rotation section 34, as seen in FIGS. 4 and 6. The holding section 31 holds the corrugated cardboard box C. The vertical movement mechanism 33 moves the holding section 31 up and down. The rotation section 34 rotates the holding section 31 and changes the orientation of the holding section 31.

The holding section 31 suctions, from below, the side surface part C14 of the corrugated cardboard box C that is the bottom surface of the corrugated cardboard box C in the product filling location, and holds the corrugated cardboard box C.

The holding section 31 has the support surface 31*a* which faces the side surface part C14 of the corrugated cardboard box C and supports the side surface part C14 (see FIG. 6). The holding section 31 has a pushing plate 35 (see FIG. 7A) that extends downward from a rear-side end part of the support surface 31*a* when the support surface 31*a* is facing upward. The pushing plate 35 is a member that pushes a turning plate 72 of the spill prevention mechanism 70, described hereinafter, and causes the turning plate 72 to rotate. Additionally, the holding section 31 has a suction cup 32 and a suction drive unit 32*a* (see FIGS. 4 and 6). The suction drive unit 32*a* is, e.g., a vacuum pump. When the suction drive unit 32*a* is driven, the suction cup 32 suctions to a predetermined position on the side surface part C14 of the corrugated cardboard box C. Due to the suction cup 32 suctioning to the side surface part C14, the side surface part C14 of the corrugated cardboard box C is pushed against the support surface 31*a*, and the corrugated cardboard box C is held by the holding section 31.

The vertical movement mechanism 33 supports the holding section 31. In other words, the vertical movement mechanism 33 supports the corrugated cardboard box C held by the holding section 31. The vertical movement mechanism 33 moves the holding section 31 up and down with the support surface 31*a* facing upward, and performs up-down positional adjustment for the holding section 31. The vertical movement mechanism 33 moves the corrugated cardboard box C, which is supported on the support surface 31*a*, up and down by moving the holding section 31 up and down. The vertical movement mechanism 33 moves the supported corrugated cardboard box C in the up-down direction so that the position of the corrugated cardboard box C changes with respect to the height position at which the products are pushed in by the push-in mechanism 50. The height position at which the products are pushed in by the push-in mechanism 50 is substantially the same as the height position of a conveying surface of a conveyor belt 81 of the product-conveying mechanism 80, on which are placed the products that are pushed out by a push-out plate 51 of the push-in mechanism 50, described hereinafter. Additionally, the vertical movement mechanism 33 moves the position of the corrugated cardboard box C upward while a shutter 61 of the shutter mechanism 60, described hereinafter, is inserted into the corrugated cardboard box C, whereby the bags A accommodating the products are compressed between an inner surface of the side surface part C14 of the corrugated cardboard box C and a lower surface of the shutter 61.

The vertical movement mechanism 33 is, specifically, a ball screw mechanism driven by a vertical drive unit 33*a* (see FIG. 4). The vertical drive unit 33*a* is, e.g., a motor. The vertical movement mechanism 33 is driven by the vertical drive unit 33*a* and thereby moves the holding section 31 in the up-down direction with the support surface 31*a* facing upward. The vertical movement mechanism 33 need not be limited to a ball screw mechanism; various configurations for supporting and moving the holding section 31 up and down can be applied.

The rotation section 34 causes the holding section 31 to rotate around a rotational shaft (not shown) extending in the left-right direction, and changes the orientation of the holding section 31. The rotation section 34 includes, e.g., an air cylinder (not shown). The air cylinder (not shown) is driven, whereby the rotation section 34 causes the holding section 31, which has the support surface 31*a* facing upward and which is holding the corrugated cardboard box C, to rotate 90 degrees around the rotational shaft so that the support surface 31*a* faces forward. Due to the rotation section 34 rotating the holding section 31 in this manner, the corrugated cardboard box C comes to a state in which the opening Op faces upward. Additionally, by rotating the corrugated cardboard box C, the rotation section 34 moves the corrugated cardboard box C onto the conveyor belt 91 of the box-conveying mechanism 90.

(2-3) Push-in Mechanism

The push-in mechanism 50 is an example of the pusher. The push-in mechanism 50 pushes the products (the bags A accommodating the products) through the opening Op (the lateral opening) of the corrugated cardboard box C into the corrugated cardboard box C, which is supported by the holding/moving section 30 and which has the opening Op facing laterally. The push-in mechanism 50 pushes the products in a push-in direction E (see FIG. 7B). The direction E in which the products are pushed in by the push-in mechanism 50 is the forward direction (see FIG. 7B).

In the present implementation, the push-in mechanism 50 repeatedly (four times for each of the corrugated cardboard boxes C in the present implementation) pushes the products into each of the corrugated cardboard boxes C. The push-in mechanism 50 loads the products a plurality of times (four times in the present implementation) into each of the corrugated cardboard boxes C, whereby the boxing apparatus 10 fills and stacks a plurality of rows of products (four rows in the present implementation) in the corrugated cardboard boxes C of which the openings Op face laterally. With one pushing-in action, the push-in mechanism 50 pushes one row of products into the corrugated cardboard box C. In the present implementation, four products are loaded with one loading action by the push-in mechanism 50, but the number of products loaded in a single action is not limited to four.

Figure 8A:
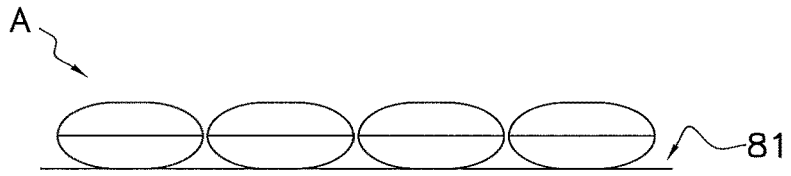
FIG. 8A, FIG. 8B, and FIG. 8C are views for illustrating an example of a manner in which the products are placed on the conveyor belt of the product-conveying mechanism of the boxing apparatus of FIG. 1, the views being from a front surface side of the products on the conveyor belt of the product-conveying mechanism.
Figure 8B:
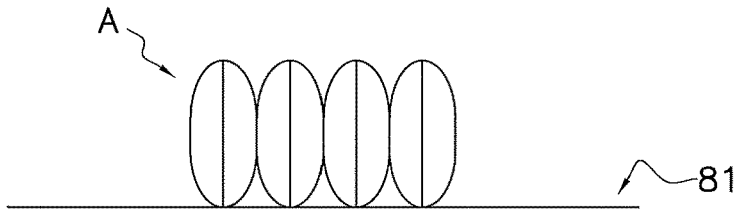
Figure 8C:
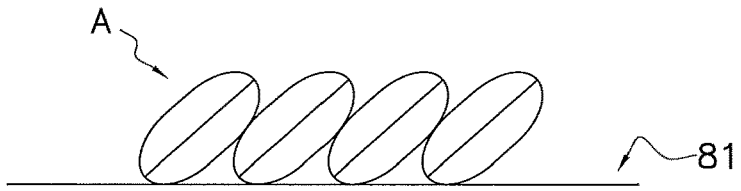
Figure 8C:
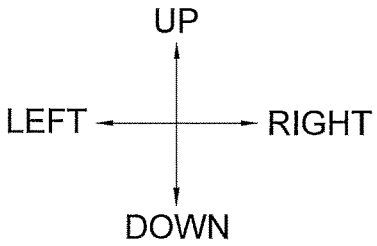

In the present implementation, the push-in mechanism 50 pushes the bags A into the corrugated cardboard boxes C, the bags A being placed on the conveyor belt 81 of the product-conveying mechanism 80 so that main surfaces (the surfaces depicted in FIG. 3A) face upward (or downward) and the lateral seals Aw are disposed in the front and rear (see FIG. 8A). However, this arrangement is not provided by way of limitation; the push-in mechanism 50 may push the bags A into the corrugated cardboard box C in an arrangement that the bags A are placed on the conveyor belt 81 of the product-conveying mechanism 80 so that, e.g., the main surfaces face to the left (or to the right) and the lateral seals Aw are disposed in the front and rear (see FIG. 8B). The push-in mechanism 50 may also push the bags A into the corrugated cardboard box C in an arrangement that the bags A are placed on the conveyor belt 81 of the product-conveying mechanism 80 so that the main surfaces are slanted at an incline and the lateral seals Aw are disposed in the front and rear (see FIG. 8C).

The push-in mechanism 50 mainly has the push-out plate 51 and a push-out drive unit 52 (see FIGS. 4 and 6).

The push-out plate 51 is a plate-shaped member disposed so as to face the opening Op of the corrugated cardboard box C disposed in the product filling location (see FIG. 7A). The push-out plate 51 is driven in the forward-backward direction by the push-out drive unit 52. The push-out drive unit 52 is not limited but is, e.g., an air cylinder.

Immediately before the loading of products (the bags A accommodating the products) begins, the push-out plate 51 is disposed behind the products conveyed to the rear of the opening Op of the corrugated cardboard box C by the product-conveying mechanism 80 (see FIG. 7A). When the push-in mechanism 50 loads the products into the corrugated cardboard box C, the push-out plate 51 is driven by the push-out drive unit 52 in the product push-in direction E (forward) into proximity to the opening Op of the corrugated cardboard box C (see FIG. 7B). At this time, the push-out plate 51 comes into contact with the product-accommodating bags A placed on the conveyor belt 81 of the product-conveying mechanism 80, and pushes the products into the corrugated cardboard box C through the opening Op. When the loading of products into the corrugated cardboard box C is finished, the push-out plate 51 is moved by the push-out drive unit 52 to the rear of the conveyor belt 81 of the product-conveying mechanism 80. The push-out plate 51 then waits behind the conveyor belt 81 until the next timing for product loading.

(2-4) Shutter Mechanism

The shutter mechanism 60 suppresses the products already loaded into a corrugated cardboard box C from being a hindrance of the product loading when the products are loaded into the corrugated cardboard box C. Additionally, the shutter mechanism 60 functions in cooperation with the vertical movement mechanism 33 of the holding/moving section 30 to compress the products into the corrugated cardboard box C and improve the percentage that the corrugated cardboard box C is filled with the products.

The shutter mechanism 60 mainly has the shutter 61 and a shutter drive unit 62 (see FIGS. 4 and 7A). The shutter drive unit 62 is not limited but is, e.g., a motor.

The shutter 61 is a plate-shaped member that enters and exits the corrugated cardboard box C of which the opening Op faces laterally (rearward) through the opening Op (the lateral opening). The shutter 61 is a horizontally spreading plate-shaped member. The shutter 61 is driven in the forward-backward direction by the shutter drive unit 62. The shutter 61 is disposed below the conveyor belt 81 of the product-conveying mechanism 80.

Figure 7B:
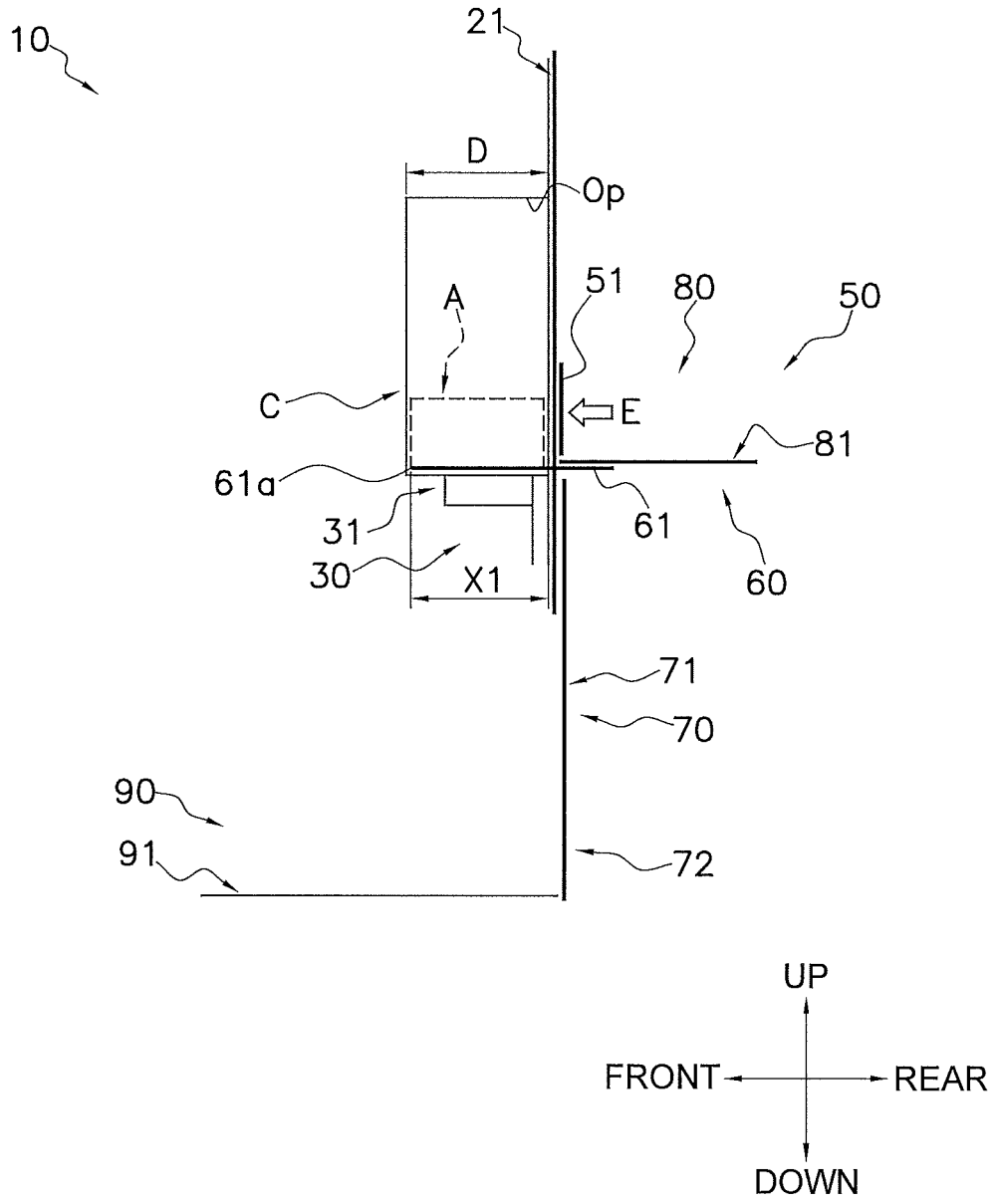
FIG. 7B is a view for illustrating the action of the boxing apparatus of FIG. 1, the view being from the right side of the boxing apparatus and depicting a state during loading of a first row of products into the corrugated cardboard box.

The shutter 61 is inserted into the corrugated cardboard box C through the opening Op before the first row of products is pushed into the corrugated cardboard box C by the push-in mechanism 50 and while the push-in mechanism 50 is pushing the first row of products into the corrugated cardboard box C (see FIG. 7B). Additionally, the shutter 61 is inserted into the corrugated cardboard box C through the opening Op before the second and subsequent rows of products are pushed in and while the push-in mechanism 50 is pushing these products into the corrugated cardboard box C (see FIGS. 7D, 7G and 7J). Before the second and subsequent rows of products are pushed in, the vertical movement mechanism 33 of the holding/moving section 30 causes the corrugated cardboard box C and the shutter 61 to move relative to each other in the up-down direction (specifically, the vertical movement mechanism 33 causes the corrugated cardboard box C to move upward relative to the shutter 61), whereby the shutter 61 compresses the products inside the corrugated cardboard box C between the shutter 61 and the side surface part C14 of the corrugated cardboard box C.

The amount by which the shutter 61 enters the corrugated cardboard box C is changed by an entry amount changing unit 41*a* of a controller 41 of the control unit 40, described hereinafter. The phrase "amount by which the shutter 61 enters the corrugated cardboard box C" refers to the amount by which the shutter 61 enters the corrugated cardboard box C in the push-in direction E of the push-in mechanism 50 (the forward-backward direction).

Figure 7C:
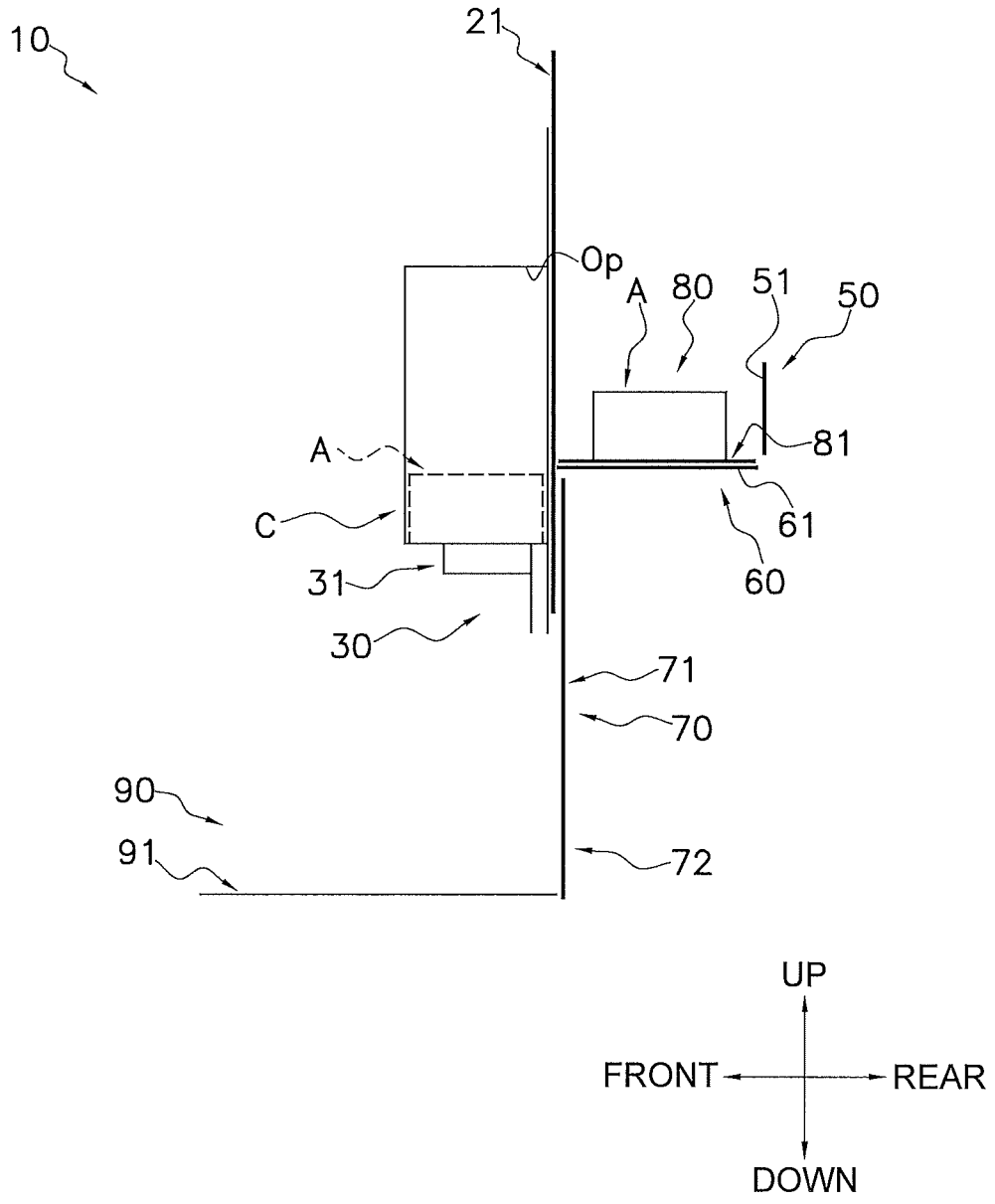
FIG. 7C is a view for illustrating the action of the boxing apparatus of FIG. 1, the view being from the right side of the boxing apparatus and depicting a state in which a height position of the corrugated cardboard box has been changed by the holding/moving section after the loading of the first row of products.
Figure 7D:
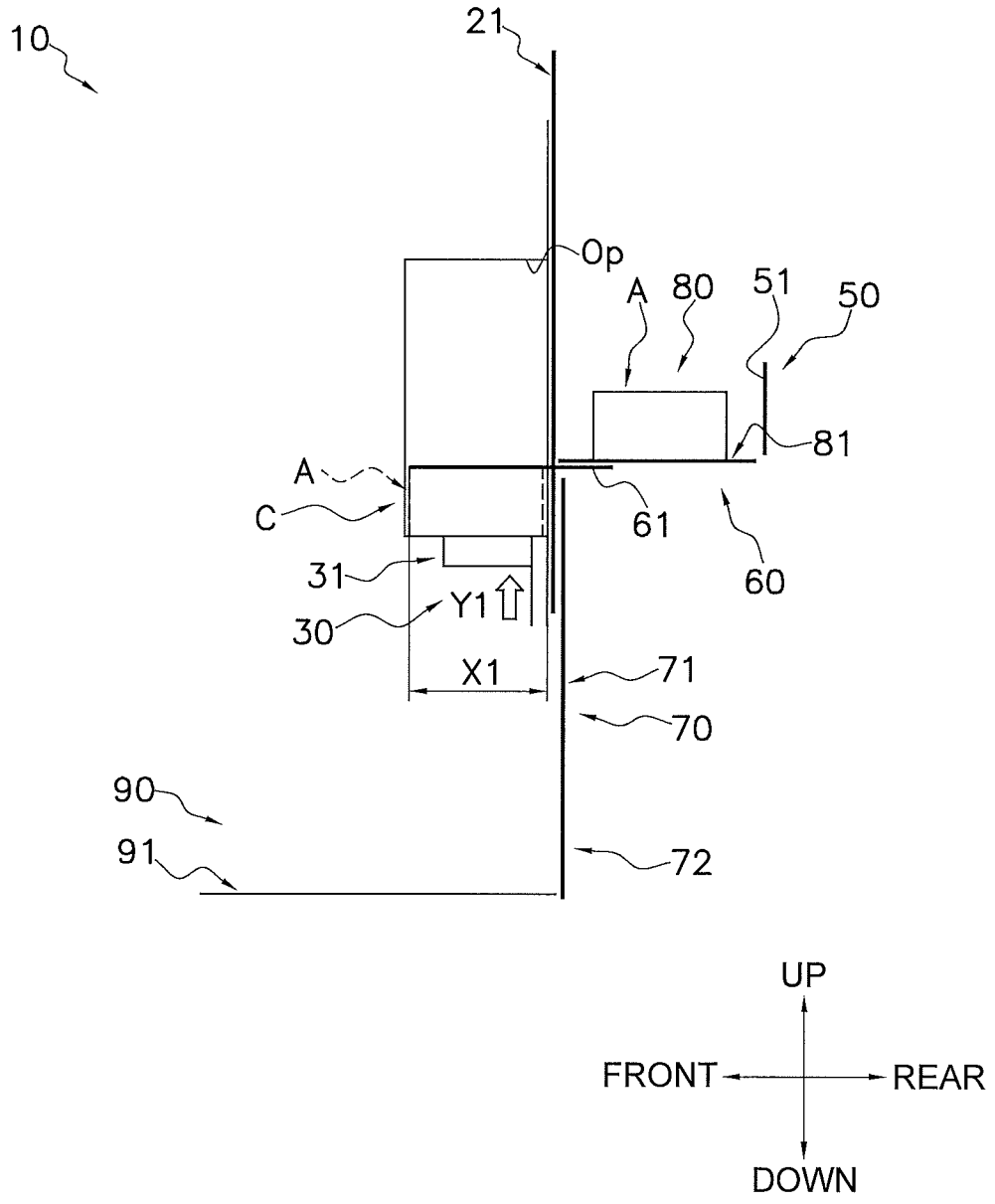
FIG. 7D is a view for illustrating the action of the boxing apparatus of FIG. 1, the view being from the right side of the boxing apparatus and depicting a state in which the products in the corrugated cardboard box are compressed before loading of a second row of products into the corrugated cardboard box.
Figure 7E:
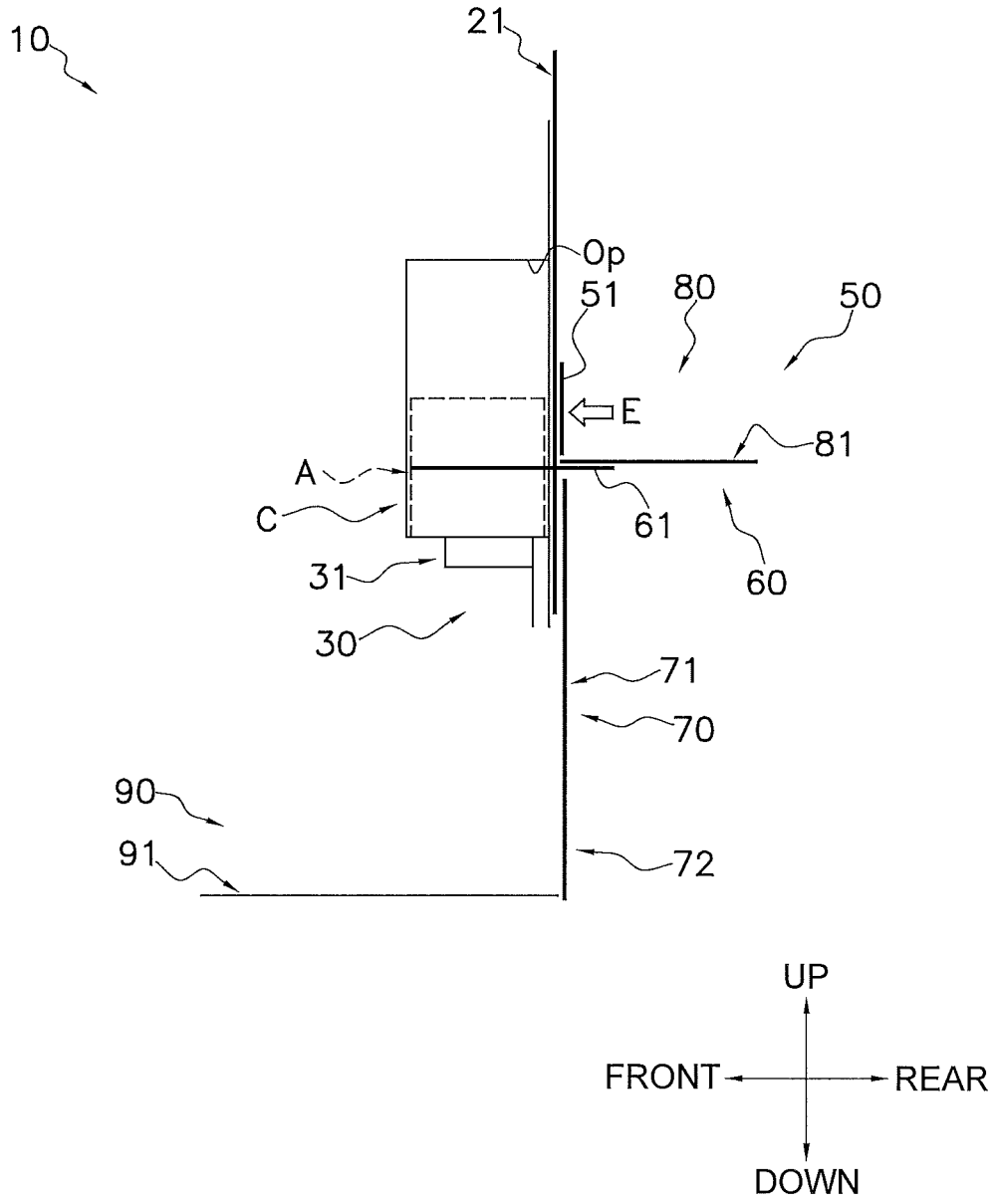
FIG. 7E is a view for illustrating the action of the boxing apparatus of FIG. 1, the view being from the right side of the boxing apparatus and depicting a state during the loading of the second row of products into the corrugated cardboard box.
Figure 7F:
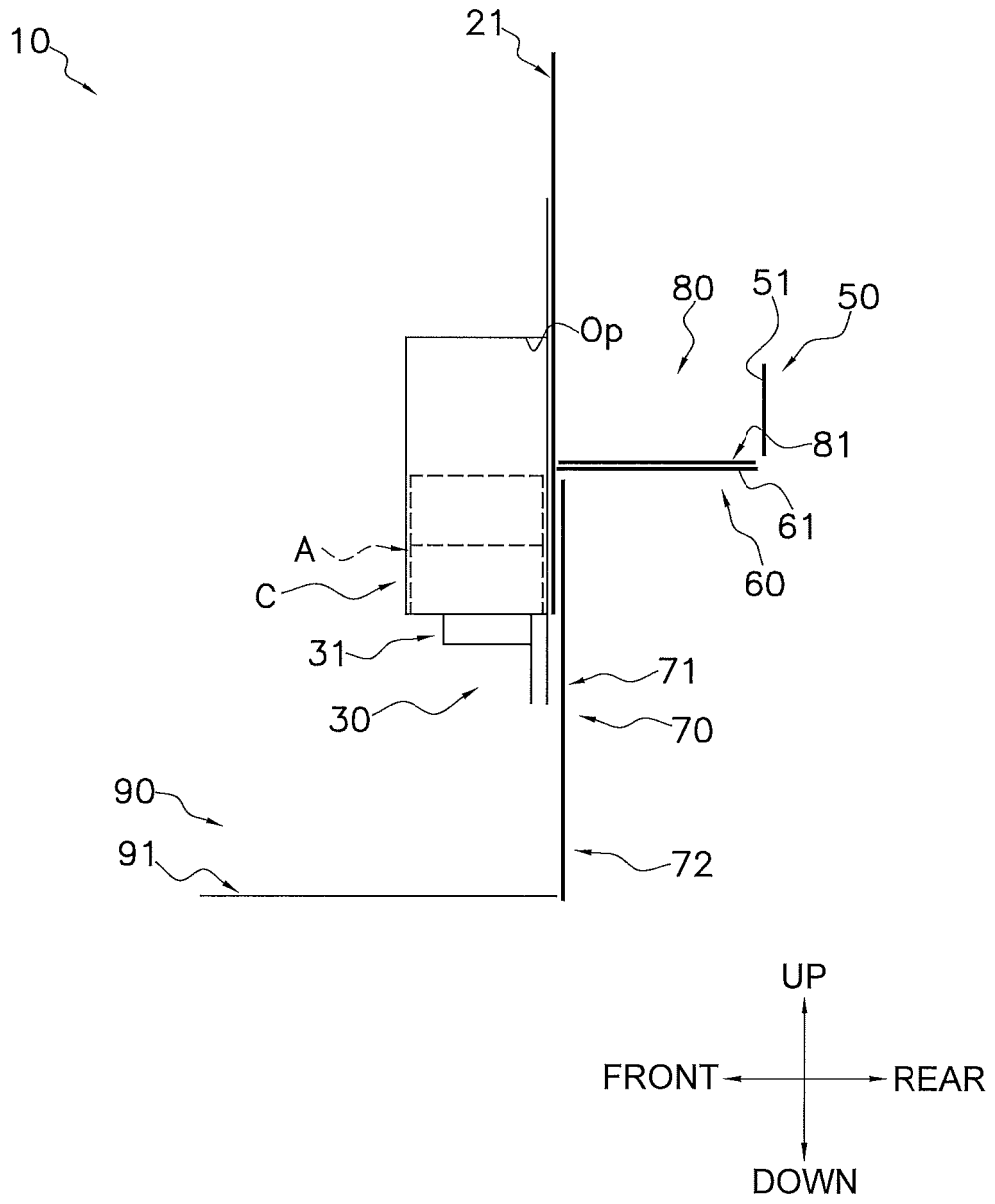
FIG. 7F is a view for illustrating the action of the boxing apparatus of FIG. 1, the view being from the right side of the boxing apparatus and depicting a state in which the height position of the corrugated cardboard box has been changed by the holding/moving section after the loading of the second row of products.
Figure 7G:
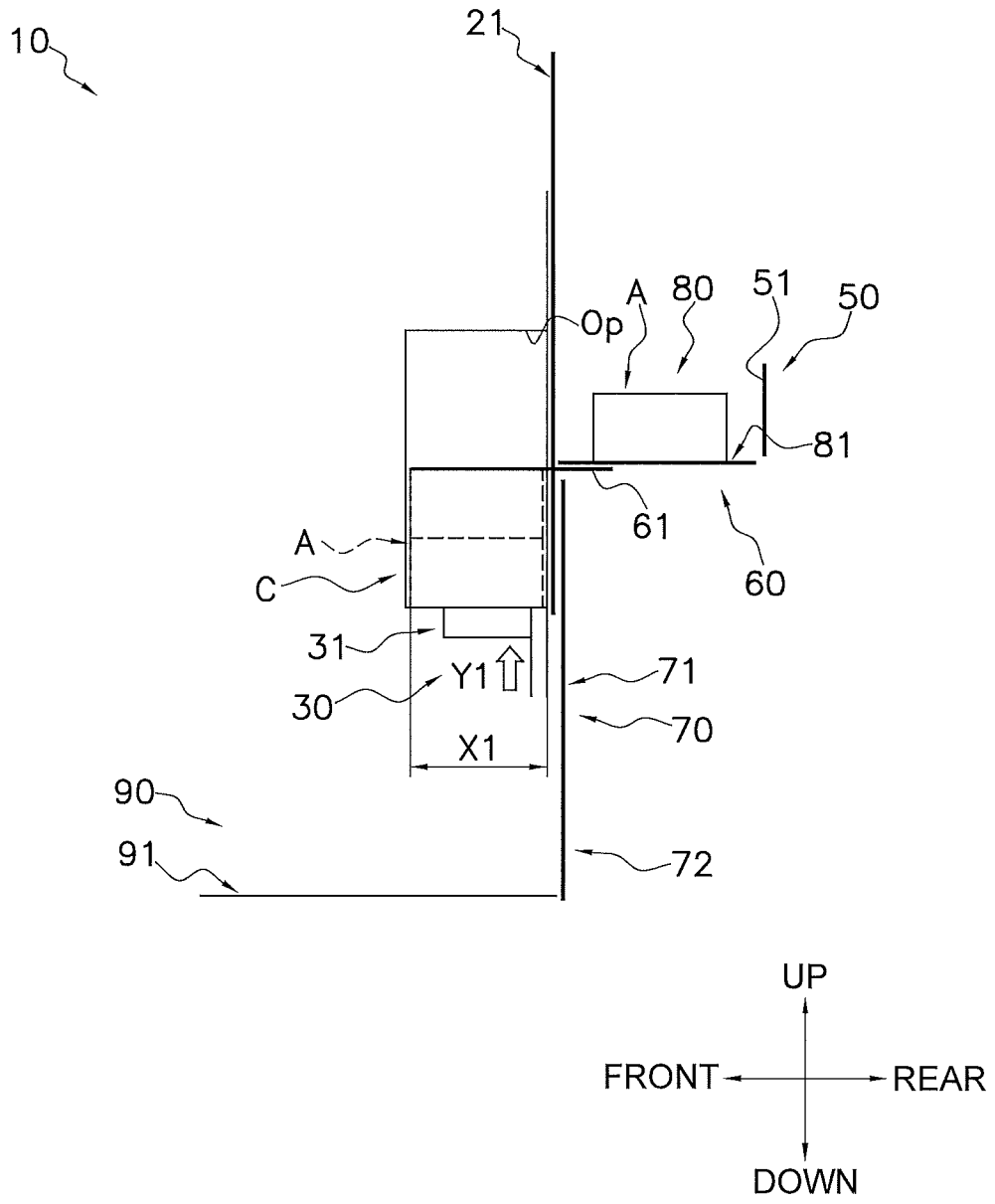
FIG. 7G is a view for illustrating the action of the boxing apparatus of FIG. 1, the view being from the right side of the boxing apparatus and depicting a state in which the products in the corrugated cardboard box are compressed before loading of a third row of products into the corrugated cardboard box.

Before the push-in mechanism 50 pushes the first through the second-to-last (third) rows of products into the corrugated cardboard box C, the entry amount changing unit 41*a* changes (sets) the entry amount of the shutter 61 to an entry amount X1 (See FIGS. 7B, 7D, and 7G). Before the push-in mechanism 50 pushes the first through third row of products into the corrugated cardboard box C, the shutter 61 is inserted into the corrugated cardboard box C so that an end part 61*a* of the shutter 61 on a downstream side in the push-in direction E comes into proximity of a wall (bottom lid B) of the corrugated cardboard box C that faces the opening Op. The entry amount X1 (see FIG. 7B) is preferably, e.g., 85% or more (and less than 100%) of a length D (see FIG. 7B) of the corrugated cardboard box C (the side surface parts C1) in the direction E that the products are pushed in by the push-in mechanism 50. With the shutter 61 having entered the corrugated cardboard box C by the entry amount X1, a distance from the end part 61*a* of the shutter 61, on the downstream side in the direction E that the products are pushed in by the push-in mechanism 50, to the bottom lid B of the corrugated cardboard box C which faces the opening Op is preferably 15% or less of a length L (see FIG. 7A) of the products in the direction E that the products are pushed in by the push-in mechanism 50. The value of the entry amount X1 is preferably set to an optimal value according to the size of the bags A in which the products are packaged, the amount of the products that are filled into the bags A, and the like.

Figure 7H:
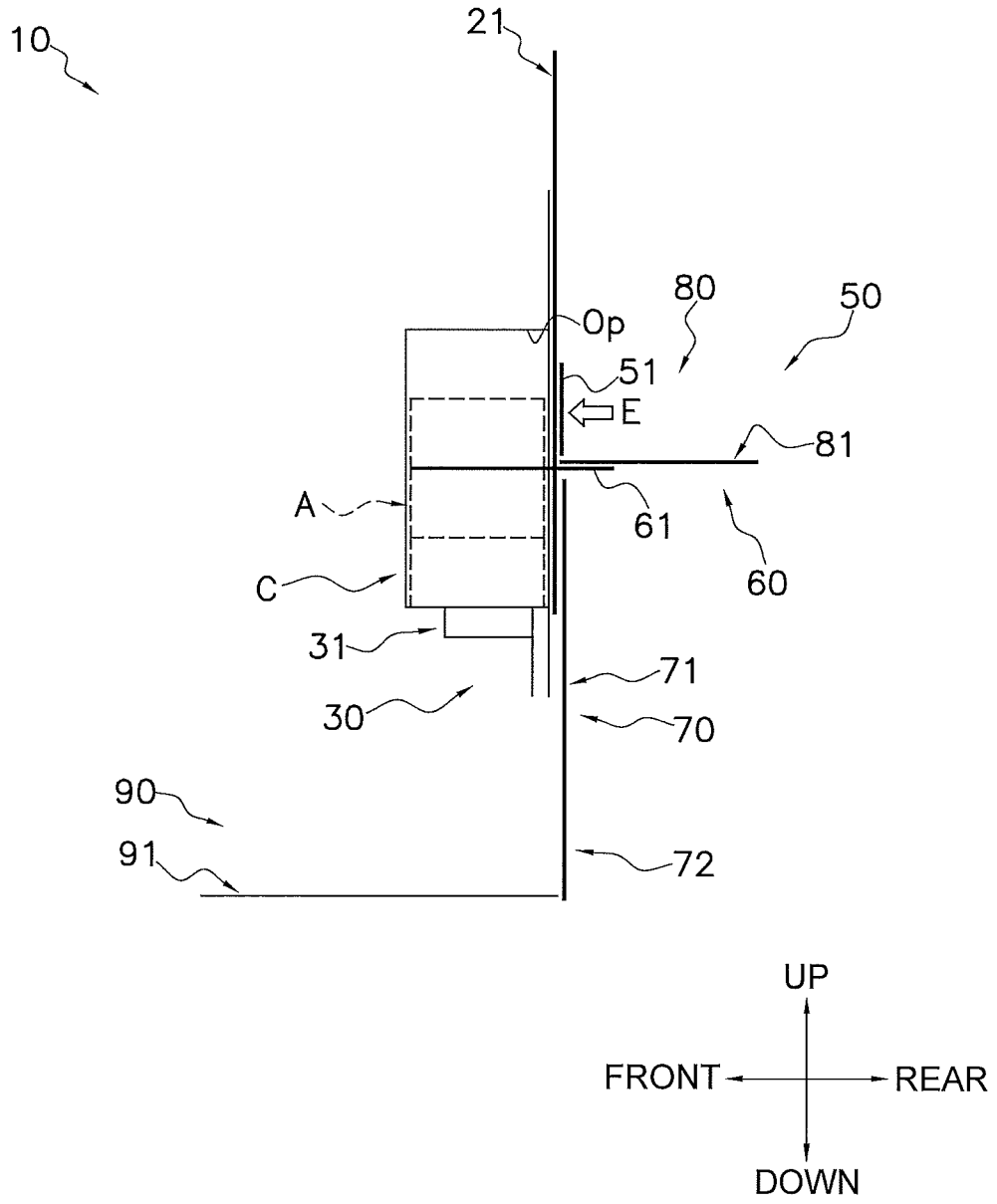
FIG. 7H is a view for illustrating the action of the boxing apparatus of FIG. 1, the view being from the right side of the boxing apparatus and depicting a state during the loading of the third row of products into the corrugated cardboard box.
Figure 7I:
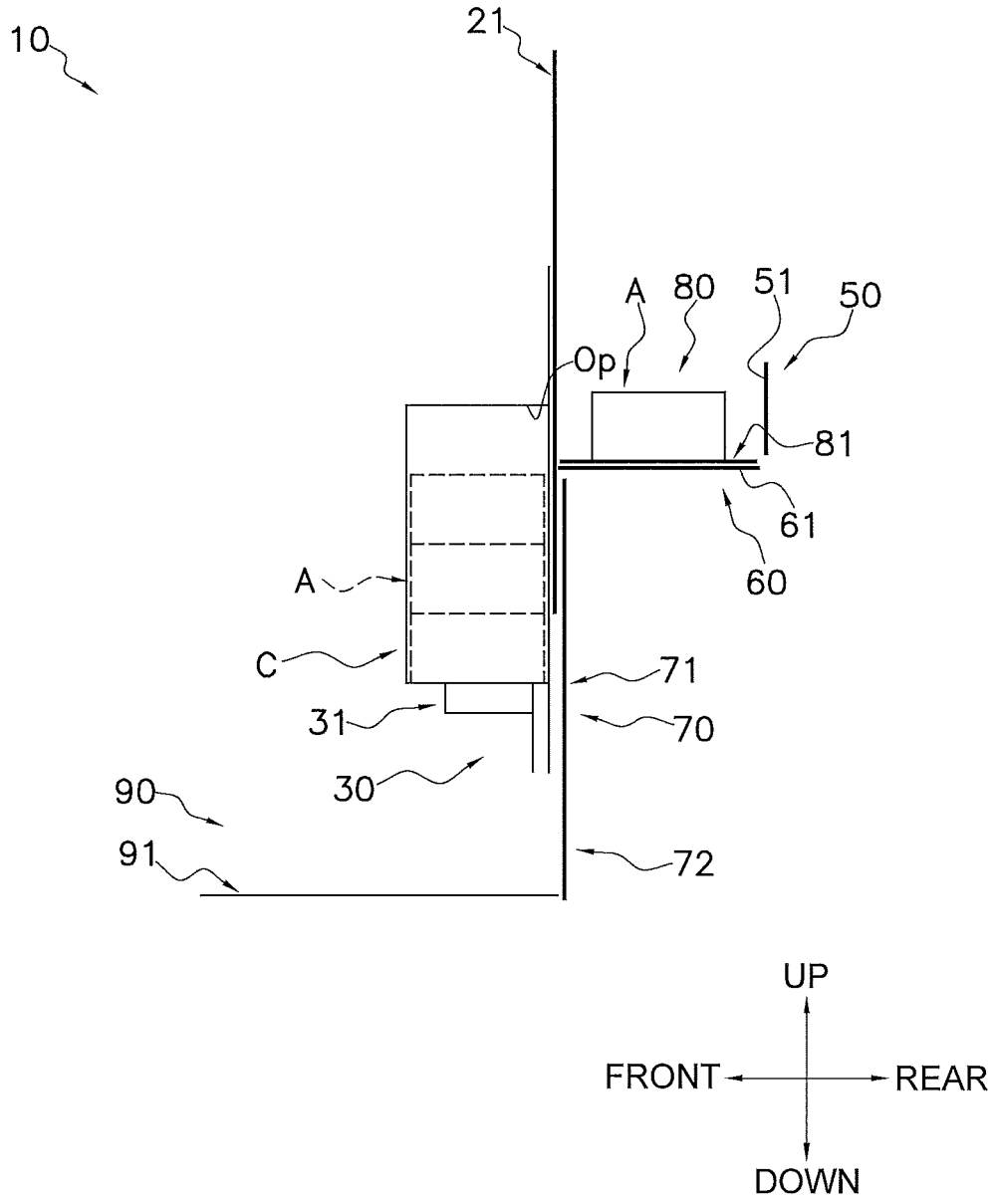
FIG. 7I is a view for illustrating the action of the boxing apparatus of FIG. 1, the view being from the right side of the boxing apparatus and depicting a state in which the height position of the corrugated cardboard box has been changed by the holding/moving section after the loading of the third row of products.
Figure 7J:
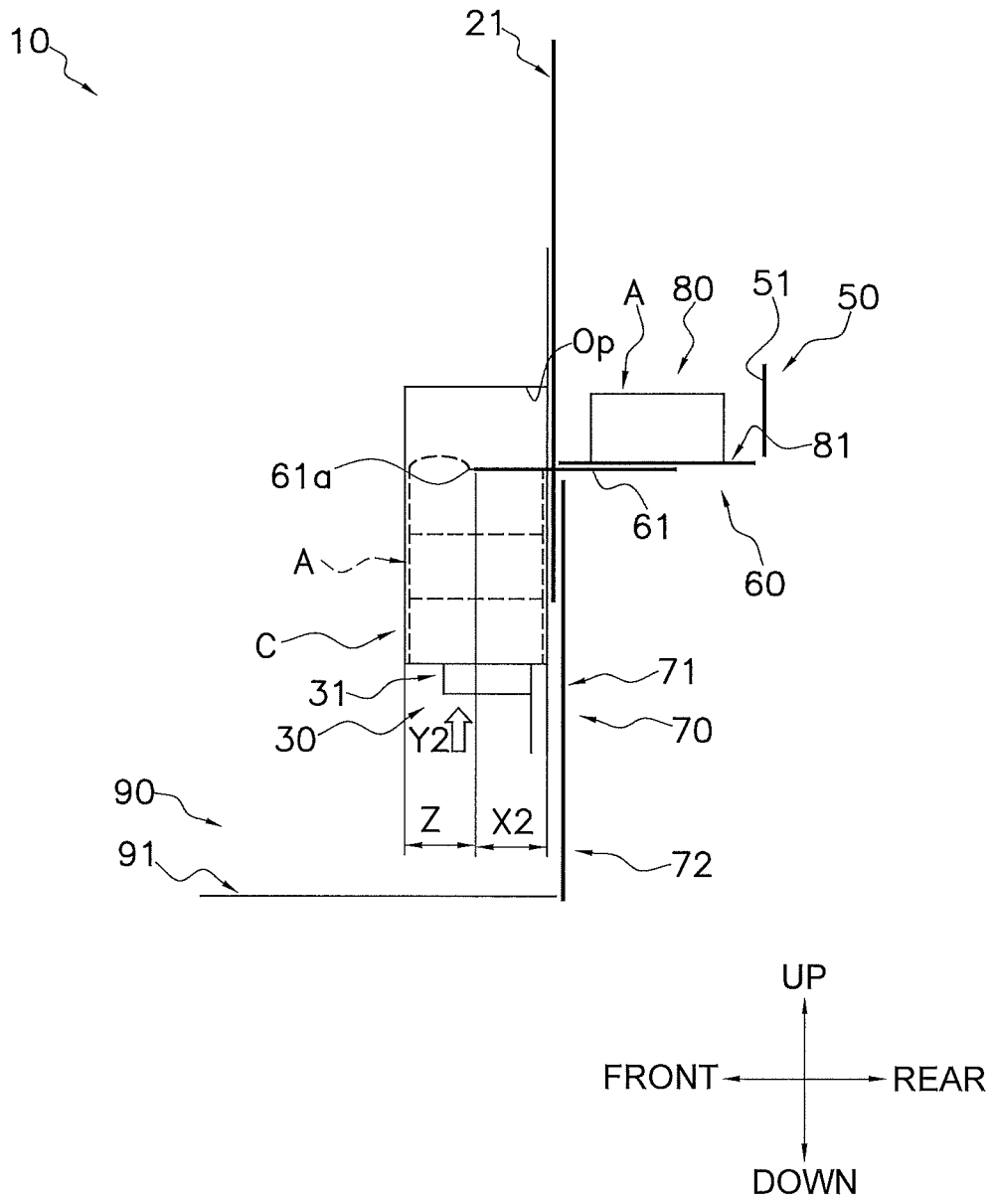
FIG. 7J is a view for illustrating the action of the boxing apparatus of FIG. 1, the view being from the right side of the boxing apparatus and depicting a state in which the products in the corrugated cardboard box are compressed before loading of a fourth row of products into the corrugated cardboard box.

Before the push-in mechanism 50 pushes the last (fourth) row of products into the corrugated cardboard box C, the entry amount changing unit 41*a* changes (sets) the entry amount of the shutter 61 to an entry amount X2 (see FIG. 7J).

The entry amount X2 is preferably 70% or less of the length D (see FIG. 7B) of the corrugated cardboard box C (the side surface parts C1) in the direction E that the products are pushed in by the push-in mechanism 50. With the shutter 61 having entered the corrugated cardboard box C by the entry amount X2, a distance Z (see FIG. 7J) from the end part 61*a* of the shutter 61, on the downstream side in the direction E that the products are pushed in by the push-in mechanism 50, to the bottom lid B of the corrugated cardboard box C which faces the opening Op is preferably 30% or more of the length L (see FIG. 7A) of the products in the direction E that the products are pushed in by the push-in mechanism 50.

The entry amount X2 is even more preferably, e.g., 30% or more and 50% or less of the length D of the corrugated cardboard box C (the side surface parts C1) in the direction E that the products are pushed in by the push-in mechanism 50. With the shutter 61 having entered the corrugated cardboard box C by the entry amount X2, the distance Z from the end part 61*a* of the shutter 61, on the downstream side in the direction E that the products are pushed in by the push-in mechanism 50, to the bottom lid B of the corrugated cardboard box C which faces the opening Op is even more preferably 50% or more and less than 70% of the length L of the products in the direction E that the products are pushed in by the push-in mechanism 50.

The entry amount changing unit 41*a* preferably changes the amount by which the shutter 61 enters the corrugated cardboard box C so that the entry amount X2 is less than a reference entry amount Xr. The reference entry amount Xr is an average of the amount by which the shutter 61 enters the corrugated cardboard box C when the products in the corrugated cardboard box C are compressed before the push-in mechanism 50 pushes in the products that, of the plurality of rows, are in the second through the second-to-last (third) rows. In this implementation, the amount by which the shutter 61 enters the corrugated cardboard box C is the entry amount X1 both before the push-in mechanism 50 pushes in the second row of products and before the push-in mechanism 50 pushes in the third row, and the reference entry amount Xr is therefore the same as the entry amount X1.

The value of the entry amount X2 is preferably set to an optimal value according to the size of the bags A in which the products are packaged, the amount of the products that are filled into the bags A, and the like.

(2-5) Spill Prevention Mechanism

The spill prevention mechanism 70 prevents the products filled into the corrugated cardboard box C from spilling out of the corrugated cardboard box C, of which the opening Op faces laterally.

Figure 7K:
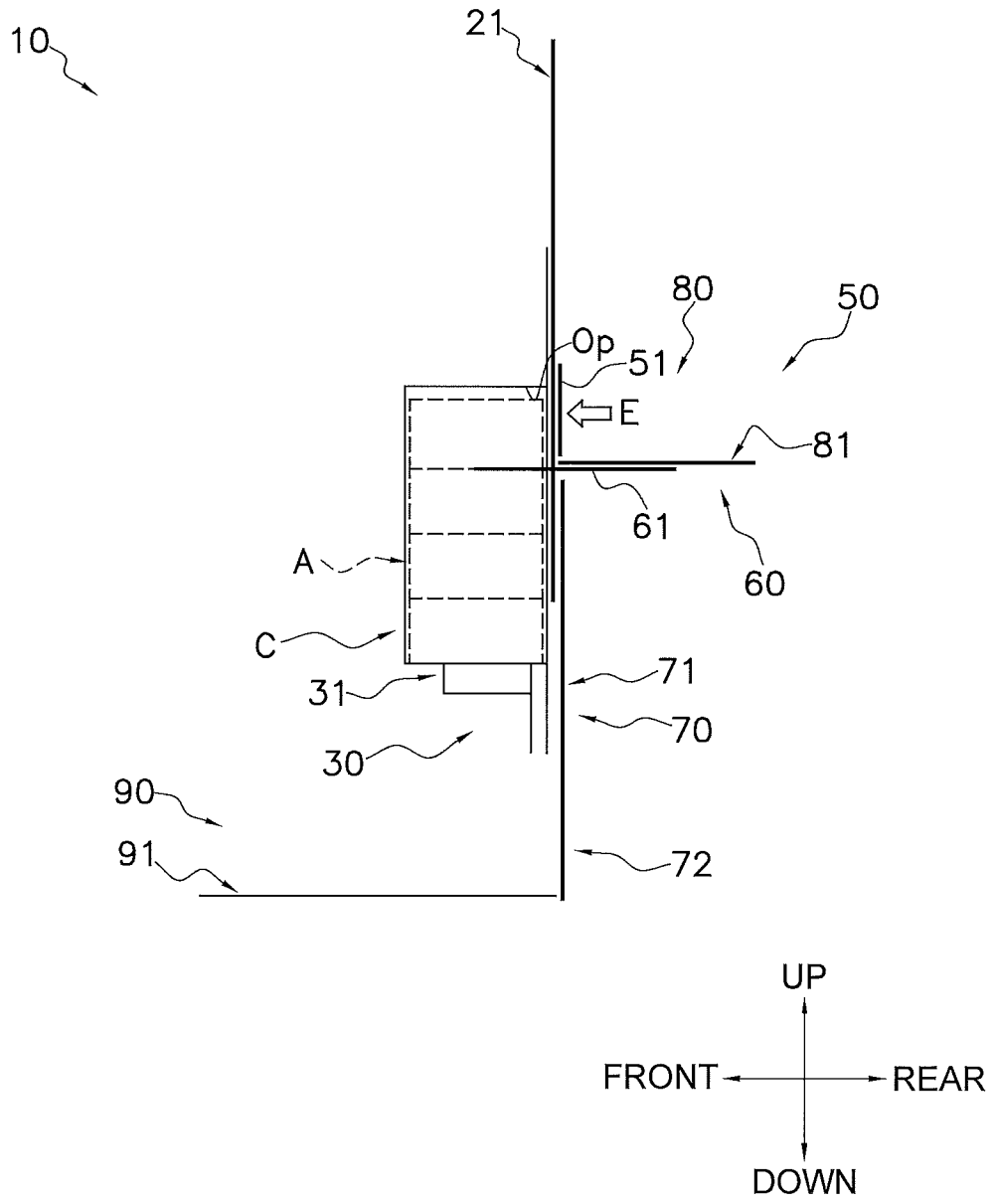
FIG. 7K is a view for illustrating the action of the boxing apparatus of FIG. 1, the view being from the right side of the boxing apparatus and depicting a state during the loading of the fourth row of products into the corrugated cardboard box.
Figure 7L:
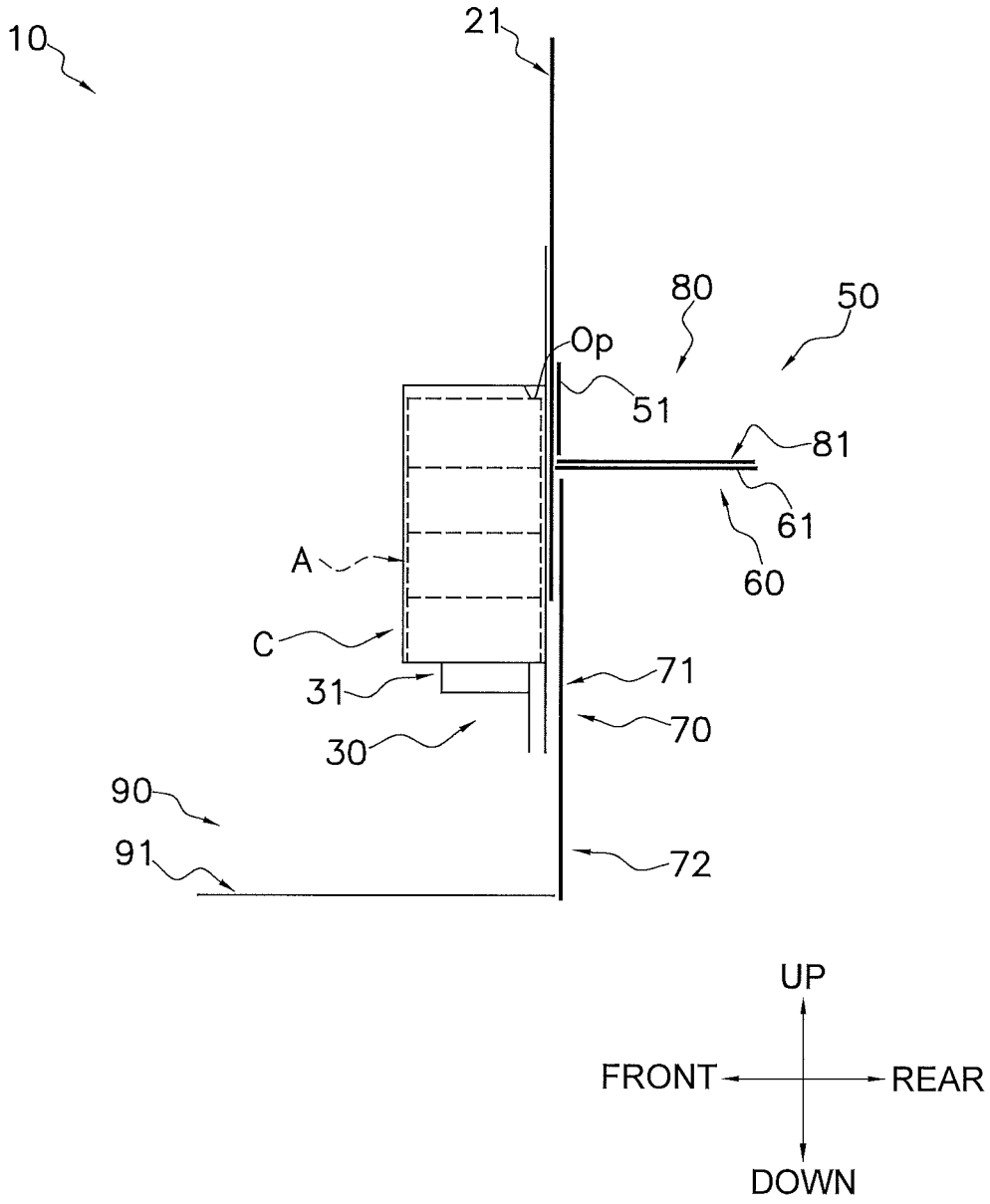
FIG. 7L is a view for illustrating the action of the boxing apparatus of FIG. 1, the view being from the right side of the boxing apparatus and depicting a state in which filling the corrugated cardboard box with products has finished.
Figure 7M:
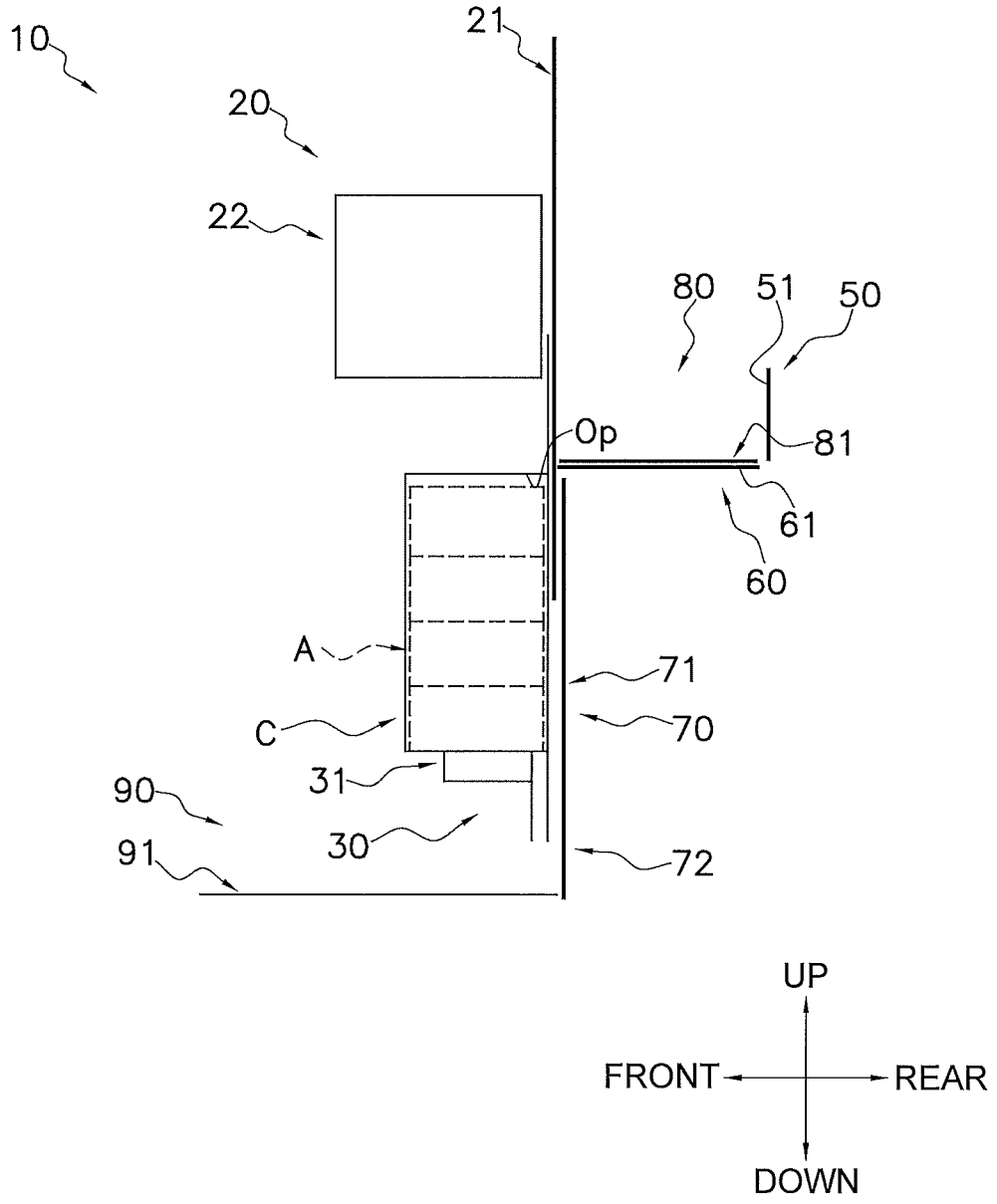
FIG. 7M is a view for illustrating the action of the boxing apparatus of FIG. 1, the view being from the right side of the boxing apparatus and depicting a state in which the holding/moving section has moved the product-filled corrugated cardboard box to a position where an orientation of the corrugated cardboard box is changed.
Figure 7N:
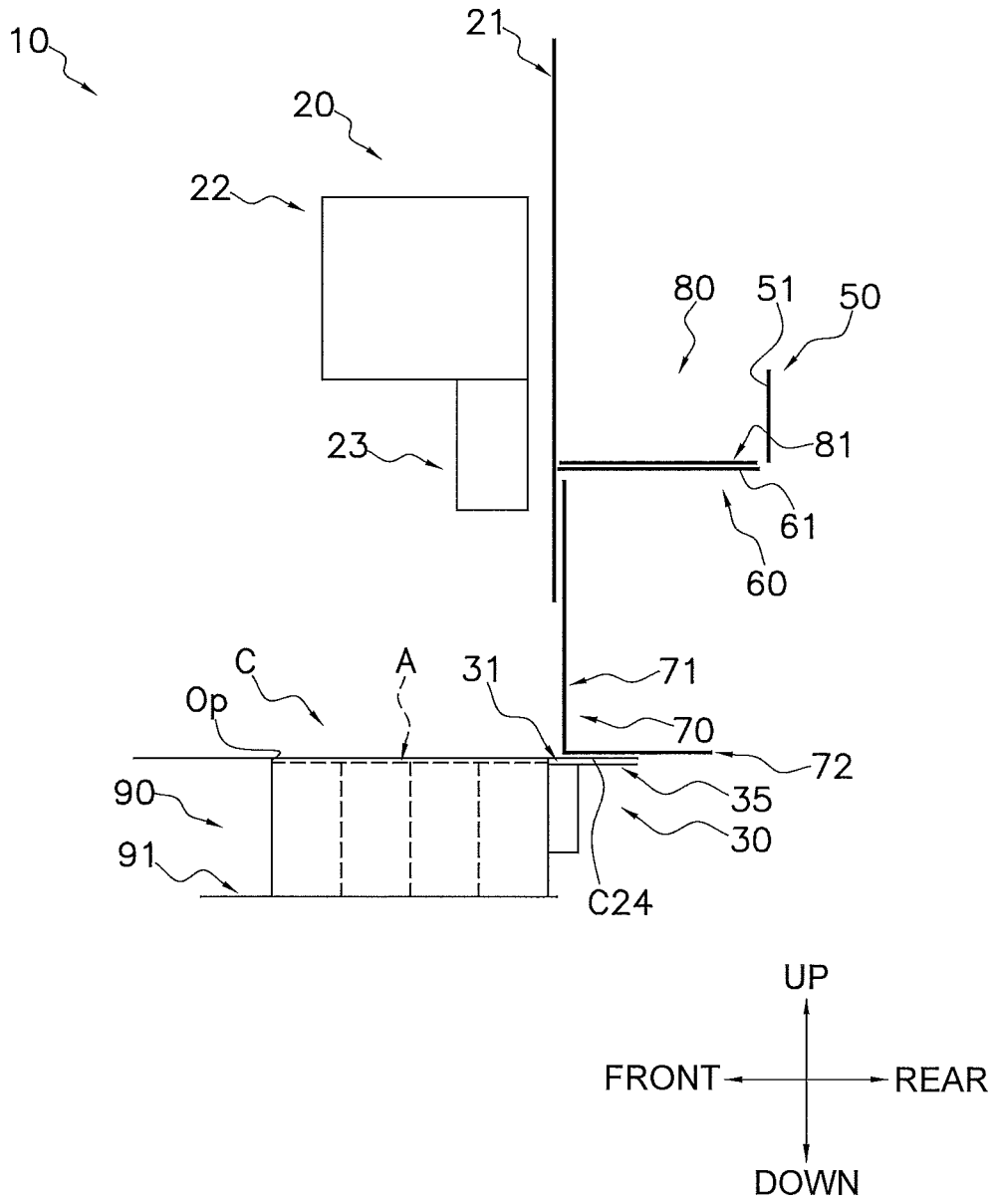
FIG. 7N is a view for illustrating the action of the boxing apparatus of FIG. 1, the view being from the right side of the boxing apparatus and depicting a state in which the holding/moving section has changed the orientation of the product-filled corrugated cardboard box and has placed the box on a conveyor belt of a box-conveying mechanism.

The spill prevention mechanism 70 mainly has a vertical plate 71 and the turning plate 72 extending from a lower end of the vertical plate 71 (see FIGS. 7A and 7N). The vertical plate 71 is a member that extends in the up-down direction. The vertical plate 71 is an immobile member. The turning plate 72 is a member capable of turning about a rotational shaft (not shown) arranged in proximity to the lower end of the vertical plate 71 and extending in the left-right direction. The turning plate 72, as seen from the right, is capable of turning 90 degrees counterclockwise about the rotational shaft proximal to the lower end of the vertical plate 71, so as to move from a vertically extending state as seen in FIG. 7M to a horizontally extending state as seen in FIG. 7N.

The vertical plate 71 has, on a front surface side, a first spill prevention surface 71*a* that faces the opening Op of the corrugated cardboard box C supported by the holding/moving section 30 (see FIG. 7A). When extending downward from the lower end of the vertical plate 71, the turning plate 72 has, on a front surface side, a second spill prevention surface 72*a* that faces the opening Op of the corrugated cardboard box C supported by the holding/moving section 30 (see FIG. 7A). The first spill prevention surface 71*a* is a flat surface spreading in the left-right direction and the up-down direction. The first spill prevention surface 71*a* is a vertical surface. When the support surface 31*a* of the holding section 31 of the holding/moving section 30 faces upward, the first spill prevention surface 71*a* and the second spill prevention surface 72*a* are disposed in the same (virtual) plane. In other words, when the support surface 31*a* of the holding section 31 of the holding/moving section 30 faces upward, the second spill prevention surface 72*a* is a flat surface spreading in the left-right direction and the up-down direction. The first spill prevention surface 71*a* and the second spill prevention surface 72*a*, which spread in the left-right direction and the up-down direction, close part of the opening Op of the corrugated cardboard box C and prevent the products from spilling out of the corrugated cardboard box C when the products are loaded into the corrugated cardboard box C and/or when the corrugated cardboard box C accommodating the products is driven in the up-down direction by the holding/moving section 30.

The second spill prevention surface 72*a* of the turning plate 72 is pushed in a direction away from the corrugated cardboard box C (rearward) (see FIG. 7N) by the pushing plate 35 of the holding section 31 when the rotation section 34 of the holding/moving section 30 rotates the holding section 31 so that the support surface 31*a* turns its state from a state in which the support surface 31*a* faces upward to a state in which the support surface 31*a* faces forward. The second spill prevention surface 72*a* is not pushed directly by the pushing plate 35, but is pushed by the pushing plate 35 via the flap C24 of the corrugated cardboard box C (see FIG. 7N).

Because the turning plate 72 is arranged to the lower end of the vertical plate 71, the spill prevention mechanism 70, without hindering the rotation of the holding section 31, can prevent the products from spilling out of the opening Op of the corrugated cardboard box C until just before the holding section 31 is rotated (just before the corrugated cardboard box C is caused to rotate by the holding/moving section 30).

(2-6) Product-Conveying Mechanism

The product-conveying mechanism 80 conveys the products to be boxed in the corrugated cardboard boxes C (see FIGS. 5 and 7A).

The product-conveying mechanism 80 mainly has the conveyor belt 81 and a conveying drive unit 82 to drive the conveyor belt 81 (see FIGS. 6 and 7A). The conveyor belt 81 is driven by the conveying drive unit 82 so as to convey the products at a predetermined speed and timing. The conveying drive unit 82 is, e.g., a motor. The conveying drive unit 82 drives the conveyor belt 81 so that products are conveyed at a predetermined timing to the front of the push-out plate 51 of the push-in mechanism 50.

(2-7) Box-Conveying Mechanism

The box-conveying mechanism 90 (see FIG. 7A) conveys the product-filled corrugated cardboard boxes C.

The box-conveying mechanism 90 mainly has the conveyor belt 91 and a conveying drive unit 92 to drive the conveyor belt 91 (see FIGS. 4 and 7A). The conveying drive unit 92 is, e.g., a motor.

In the box-conveying mechanism 90, the conveying drive unit 92 drives the conveyor belt 91, whereby the product-filled corrugated cardboard boxes C, which have been moved from the product filling location onto the conveyor belt 91 by the holding/moving section 30, are conveyed and supplied to the box-closing apparatus 3 at a predetermined speed and timing. The box-conveying mechanism 90 conveys the corrugated cardboard boxes C with the openings Op facing upward to the box-closing apparatus 3.

(2-8) Control Unit

The control unit 40 is electrically connected with the various configurations of the boxing apparatus 10 and the various configurations (not shown) of the box-making apparatus 2 and the box-closing apparatus 3 and controls the actions of the various configurations of the box-making apparatus 2, the boxing apparatus 10, and the box-closing apparatus 3. The control unit 40 controls the actions of, e.g., the lowering mechanism 20, the holding/moving section 30, the push-in mechanism 50, the shutter mechanism 60, the product-conveying mechanism 80, and the box-conveying mechanism 90 of the boxing apparatus 10.

The control unit 40 is configured from the controller 41, which mainly has a central processing unit (CPU), and/or a storage unit 42, which mainly has a read only memory (ROM), a random access memory (RAM), and a hard disk drive (HDD), and the like.

The controller 41 calls up and executes various programs stored in the storage unit 42, and controls the components of the box-making apparatus 2 and the box-closing apparatus 3.

Additionally, the controller 41 calls up and executes the various programs stored in the storage unit 42, and controls the actions of the lowering mechanism 20, the holding/moving section 30, the push-in mechanism 50, the shutter mechanism 60, the product-conveying mechanism 80, the box-conveying mechanism 90, and other components of the boxing apparatus 10.

For example, before the push-in mechanism 50 pushes the second through fourth rows of products into a corrugated cardboard box C, the controller 41 controls the shutter drive unit 62 and the vertical drive unit 33*a* for causing the shutter 61 to enter the corrugated cardboard box C and the vertical movement mechanism 33 to actuate and thereby compressing the products inside the corrugated cardboard box C. The controller 41 has the entry amount changing unit 41*a* and a movement amount changing unit 41*b* as function units associated with the compressing of products inside the corrugated cardboard box C before the products are pushed in.

The entry amount changing unit 41*a* is a function unit which changes the amount by which the shutter 61 enters the corrugated cardboard box C. In other words, the entry amount changing unit 41*a* changes the amount by which the shutter 61 enters the corrugated cardboard box C when the products in the corrugated cardboard box C are compressed between the shutter 61 and the corrugated cardboard box C. The entry amount changing unit 41*a* also changes the amount by which the shutter 61 enters the corrugated cardboard box C before the first row of products is pushed into the corrugated cardboard box C. Because a description has already been given of the manner in which the entry amount changing unit 41*a* changes the amount by which the shutter 61 enters the corrugated cardboard box C before the push-in mechanism 50 pushes the first through fourth rows of products into the corrugated cardboard box C, the description is omitted here.

The movement amount changing unit 41*b* is a function unit which changes the amount of relative movement between the corrugated cardboard box C and the shutter 61 caused by the vertical movement mechanism 33 when the products inside the corrugated cardboard box C are compressed.

Before the push-in mechanism 50 pushes the second through the second-to-last (third) rows of products into the corrugated cardboard box C, the movement amount changing unit 41*b* changes (sets) the amount of relative movement between the corrugated cardboard box C and the shutter 61 caused by the vertical movement mechanism 33 (the amount of upward movement of the corrugated cardboard box C caused by the vertical movement mechanism 33) when the products inside the corrugated cardboard box C are compressed to a movement amount Y1 (see FIGS. 7D and 7G).

Before the push-in mechanism 50 pushes the last (fourth) row of products into the corrugated cardboard box C, the movement amount changing unit 41*b* changes (sets) the amount of relative movement between the corrugated cardboard box C and the shutter 61 caused by the vertical movement mechanism 33 (the amount of upward movement of the corrugated cardboard box C caused by the vertical movement mechanism 33) when the products inside the corrugated cardboard box C are compressed to a movement amount Y2 (see FIG. 7J). The movement amount Y2 is greater than the movement amount Y1.

The movement amount changing unit 41*b* preferably changes the amount of upward movement of the corrugated cardboard box C caused by the vertical movement mechanism 33 so that the movement amount Y2 is less than a reference movement amount Yr. The reference movement amount Yr is an average of the amount of relative movement between the corrugated cardboard box C and the shutter 61 caused by the vertical movement mechanism 33 (the amount of upward movement of the corrugated cardboard box C caused by the vertical movement mechanism 33) when the products inside the corrugated cardboard box C are compressed before the push-in mechanism 50 pushes in the second through the second-to-last (third) rows of products. In this implementation, the movement amount of the corrugated cardboard box C caused by the vertical movement mechanism 33 when the products inside the corrugated cardboard box C are compressed is the movement amount Y1 both before the push-in mechanism 50 pushes in the second row of products into the corrugated cardboard box C and before the push-in mechanism 50 pushes in the third row of products into the corrugated cardboard box C, and the reference movement amount Yr is therefore the same as the movement amount Y1.

(3) Actions of Boxing Apparatus

Figure 9:
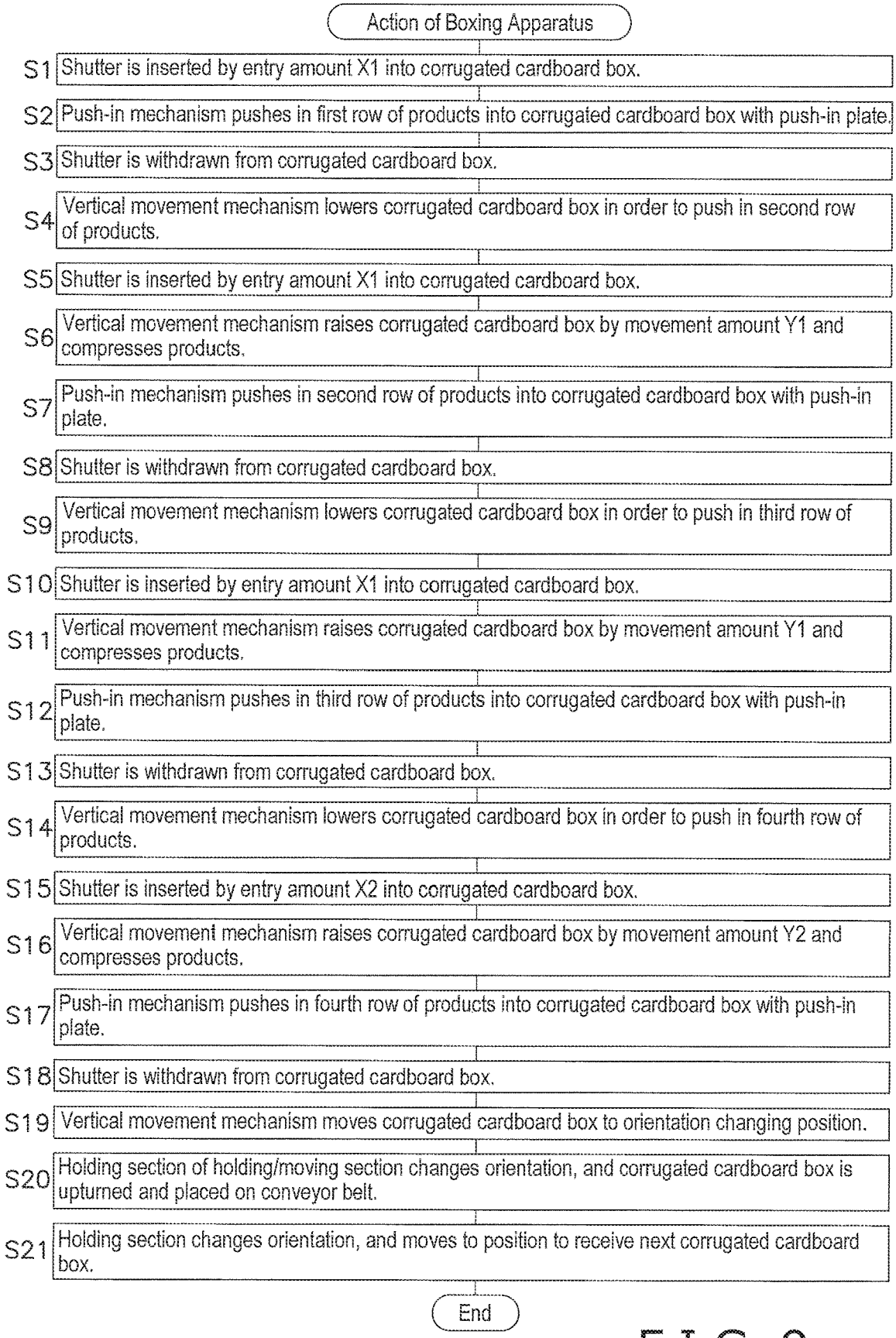
FIG. 9 is a flowchart for illustrating the actions of the boxing apparatus of FIG. 1.

The actions of the boxing apparatus 10 are described while referring to FIGS. 7A to 7N and FIG. 9. The actions of the components of the boxing apparatus 10 are controlled by the controller 41 as described above. The actions of the boxing apparatus 10 are described here by using a state in which a corrugated cardboard box C has been moved by the vertical movement mechanism 33 to the product push-in position (the height position at which the products are pushed in by the push-in mechanism 50) in the product filling location as a reference (see FIG. 7A).

In FIGS. 7B to 7L, depictions of the second guide members 22 and the third guide members 23 are omitted from the standpoint of visibility. The second guide members 22 and the third guide members 23, which are disposed to the left and right of the corrugated cardboard box C as seen in FIG. 7A at the timings illustrated in FIGS. 7B to 7L, regulate the horizontal movement of the corrugated cardboard box C.

First, in step 51, the shutter drive unit 62 is controlled by the controller 41 and the shutter 61 is inserted into the corrugated cardboard box C (see FIG. 7B). At this time, the entry amount of the shutter 61 is changed (set) to the entry amount X1 by the entry amount changing unit 41*a*.

Next, in step S2, the push-out drive unit 52 is controlled by the controller 41, and the push-in mechanism 50 (the push-out plate 51) pushes the products on the conveyor belt 81 of the product-conveying mechanism 80 into the corrugated cardboard box C (see FIG. 7B).

Next, in step S3, the shutter drive unit 62 is controlled by the controller 41, and the shutter 61 is withdrawn from the interior of the corrugated cardboard box C (see FIG. 7C).

Next, in step S4, the vertical drive unit 33*a* is controlled by the controller 41, and the vertical movement mechanism 33 lowers the corrugated cardboard box C (the holding section 31 holding the corrugated cardboard box C) by a predetermined movement amount (see FIG. 7C). The predetermined movement amount is set to, e.g., at least a height of the products on the conveyor belt 81 of the product-conveying mechanism 80.

Next, in step S5, the shutter drive unit 62 is controlled by the controller 41, and the shutter 61 is inserted into the corrugated cardboard box C (see FIG. 7D). At this time, the entry amount of the shutter 61 is changed (set) to the entry amount X1 by the entry amount changing unit 41*a*.

Next, in step S6, the vertical drive unit 33*a* is controlled by the controller 41, and the vertical movement mechanism 33 raises the corrugated cardboard box C (see FIG. 7D). At this time, the movement amount of the corrugated cardboard box C (the movement amount of the holding section 31) is changed (set) to the movement amount Y1 by the movement amount changing unit 41*b*. The movement amount Y1 is set so that the products inside the corrugated cardboard box C come into contact with at least the shutter 61.

Next, in step S7, the push-out drive unit 52 is controlled by the controller 41, and the push-in mechanism 50 pushes the products (the second row of products) on the conveyor belt 81 of the product-conveying mechanism 80 into the corrugated cardboard box C (see FIG. 7E).

Next, in step S8, the shutter drive unit 62 is controlled by the controller 41, and the shutter 61 is withdrawn from the interior of the corrugated cardboard box C (see FIG. 7F).

Next, in step S9, the vertical drive unit 33*a* is controlled by the controller 41, and the vertical movement mechanism 33 lowers the corrugated cardboard box C by the predetermined movement amount (see FIG. 7F), as in step S4.

Next, in step S10, the shutter drive unit 62 is controlled by the controller 41, and the shutter 61 is inserted into the corrugated cardboard box C (see FIG. 7G). At this time, the entry amount of the shutter 61 is changed (set) to the entry amount X1 by the entry amount changing unit 41*a*.

Next, in step S11, the vertical drive unit 33*a* is controlled by the controller 41, and the vertical movement mechanism 33 raises the corrugated cardboard box C (see FIG. 7G). At this time, the movement amount of the corrugated cardboard box C is changed (set) to the movement amount Y1 by the movement amount changing unit 41*b*.

Next, in step S12, the push-out drive unit 52 is controlled by the controller 41, and the push-in mechanism 50 pushes the products (the third row of products) on the conveyor belt 81 of the product-conveying mechanism 80 into the corrugated cardboard box C (see FIG. 7H).

Next, in step S13, the shutter drive unit 62 is controlled by the controller 41, and the shutter 61 is withdrawn from the interior of the corrugated cardboard box C (see FIG. 7I).

Next, in step S14, the vertical drive unit 33*a* is controlled by the controller 41, and the vertical movement mechanism 33 lowers the corrugated cardboard box C by the predetermined movement amount (see FIG. 7I), as in step S4.

Next, in step S15, the shutter drive unit 62 is controlled by the controller 41, and the shutter 61 is inserted into the corrugated cardboard box C (see FIG. 7J). At this time, the entry amount of the shutter 61 is changed (set) to the entry amount X2 by the entry amount changing unit 41*a*.

Next, in step S16, the vertical drive unit 33*a* is controlled by the controller 41, and the vertical movement mechanism 33 raises the corrugated cardboard box C (see FIG. 7J). At this time, the movement amount of the corrugated cardboard box C is changed (set) to the movement amount Y2 by the movement amount changing unit 41*b*. At this time, the bags A in which the products are packed deform and can spread out from a gap between the shutter 61 and the bottom lid B of the corrugated cardboard box C into an upper space of the corrugated cardboard box C (a space above the shutter 61), as shown in FIG. 7J.

Next, in step S17, the push-out drive unit 52 is controlled by the controller 41, and the push-in mechanism 50 pushes the products (the fourth row of products) on the conveyor belt 81 of the product-conveying mechanism 80 into the corrugated cardboard box C (see FIG. 7K).

Next, in step S18, the shutter drive unit 62 is controlled by the controller 41, and the shutter 61 is withdrawn from the interior of the corrugated cardboard box C (see FIG. 7L).

Next, in step S19, the vertical drive unit 33*a* is controlled by the controller 41, and the holding section 31 holding the corrugated cardboard box C is moved in the up-down direction by the vertical movement mechanism 33 to the height position at which the rotation section 34 causes the holding section 31 to rotate (see FIG. 7M). When the holding section 31 is lowered by the vertical movement mechanism 33 in step S19, the state of the third guide members 23 of the lowering mechanism 20, which had been in the first state up to this point, is switched to the second state. In other words, when the holding section 31 is lowered by the vertical movement mechanism 33, the third guide members 23 are driven by the second drive unit 25 and moved to a position at which the third guide members 23 is not in contact with the corrugated cardboard box C supported by the holding/moving section 30 (see FIG. 7M).

In step S20, the rotation section 34 of the holding/moving section 30, controlled by the controller 41, rotates the holding section 31. The rotation section 34 rotates the holding section 31 and changes the orientation of the holding section 31 so that the support surface 31*a* of the holding section 31 having been faced upward faces forward. In a right side surface view, the rotation section 34 rotates the holding section 31 counterclockwise. As a result, the corrugated cardboard box C with the bottom lid B facing downward is placed on the conveyor belt 91 of the box-conveying mechanism 90 (see FIG. 7N). When the holding section 31 is rotated by the rotation section 34, the pushing plate 35 of the holding section 31 pushes the turning plate 72 of the spill prevention mechanism 70, and in a right side surface view, the state of the turning plate 72 shifts from a state that the turning plate 72 extends downward from the lower end of the vertical plate 71 to a state that the turning plate 72 extends rearward (see FIGS. 7M and 7N).

After step S20 has been carried out, the second guide members 22 and the third guide members 23 of the lowering mechanism 20 are moved forward by the first drive unit 24 in preparation for lowering the next corrugated cardboard box C. The third guide members 23, which are in the second state, are driven by the second drive unit 25 and switched to the first state of being able to guide the side surface parts C1 and the flaps C2 of the corrugated cardboard box C (see FIG. 7N), and the like.

Then, in step S21, the holding section 31 of the holding/moving section 30 is caused to change orientation (caused to rotate) by the rotation section 34 so that the support surface 31*a* faces upward, and is moved to a position for receiving the next corrugated cardboard box C (an illustration of this arrangement is omitted).

The actions of the boxing apparatus 10 illustrated in FIGS. 7A to 7N and described using the flowchart of FIG. 9 constitute one example and are not limited thereto.

(4) Characteristics

The boxing apparatus 10 according to the present implementation packs the plurality of rows of products packaged in the bags A, which are one example of soft packaging materials, into the corrugated cardboard box C. The boxing apparatus 10 includes the push-in mechanism 50 serving as an example of a pusher, the shutter 61 serving as an example of a plate-shaped member, the vertical movement mechanism 33, and the controller 41. The push-in mechanism 50 repeatedly pushes the products into the corrugated cardboard box C through the opening Op (the lateral opening) of the corrugated cardboard box C. The shutter 61 enters and exits the corrugated cardboard box C through the opening Op. The vertical movement mechanism 33 moves the corrugated cardboard box C and the shutter 61 up and down relative to each other. In the present implementation, the vertical movement mechanism 33 moves the corrugated cardboard box C up and down relative to the shutter 61. The controller 41 causes the shutter 61 to enter the corrugated cardboard box C, and actuates the vertical movement mechanism 33 to compress the products in the corrugated cardboard box C. The controller 41 has the entry amount changing unit 41*a*, which changes the amount by which the shutter 61 enters the corrugated cardboard box C when the products in the corrugated cardboard box C are compressed.

If the shutter 61 is always entered near to a side wall (the bottom lid B of the corrugated cardboard box C) on the distal side from the opening Op (for example, as is done before the second row of products is loaded in the above implementation) when the shutter 61 and the corrugated cardboard box C are moved relative to each other to compress the products, there is very little space for the compressed bags A to deform and escape (deform and spread out). Therefore, product-containing bags A are readily damaged when the products are compressed.

As a countermeasure, in this boxing apparatus 10, the amount by which the shutter 61 enters the corrugated cardboard box C can be changed, and a space for the bags A to deform and escape can be ensured by changing the entry amount of the shutter 61 smaller. In other words, the deformed bags A can spread out from the gap between the shutter 61 and the corrugated cardboard box C (the gap between the shutter 61 and the bottom lid B) into the space above the shutter 61 due to reducing the entry amount of the shutter 61. Accordingly, damage to the bags A can be prevented. Even when the entry amount of the shutter 61 is small, the products inside the corrugated cardboard box C are compressed by the shutter 61 on the opening Op side, and space for the products pushed next by the push-in mechanism 50 to enter into the corrugated cardboard box C can therefore be ensured. Therefore, the product-filled rate in the corrugated cardboard box C can be improved even when the entry amount of the shutter 61 is small.

In the boxing apparatus 10 according to the present implementation, when the products in the corrugated cardboard box C are compressed before the last row of products of the plurality of rows is pushed in by the push-in mechanism 50, the entry amount changing unit 41*a* changes the amount X2 by which the shutter 61 enters the corrugated cardboard box C to 70% or less of the length D of the corrugated cardboard box C in the direction E that the products are pushed in by the push-in mechanism 50.

Immediately before the last row of products is pushed into the corrugated cardboard box C, the corrugated cardboard box C has already been filled with a large number of products, and product-filled rate is comparatively high. Therefore, the bags A are readily damaged particularly when the uppermost row of products (the second-to-last row of the plurality of rows) in the corrugated cardboard box C is compressed.

However, in this boxing apparatus 10, immediately before the last row of products is pushed in, the entry amount X2 of the shutter 61 during product compression is suppressed to 70% or less of the length D of the corrugated cardboard box C in the product push-in direction E, and damage to the bags A is therefore readily prevented.

More preferably, when the products in the corrugated cardboard box C are compressed before the last row of products of the plurality of rows is pushed in by the push-in mechanism 50, the entry amount changing unit 41*a* changes the amount X2 by which the shutter 61 enters the corrugated cardboard box C to 30% or more and 50% or less of the length D of the corrugated cardboard box C in the direction E that the products are pushed in by the push-in mechanism 50. In this case, damage to the bags A is even more readily prevented.

In the boxing apparatus 10 according to the present implementation, when the products in the corrugated cardboard box C are compressed before the last row of products of the plurality of rows is pushed in by the push-in mechanism 50, the entry amount changing unit 41*a* changes the amount by which the shutter 61 enters the corrugated cardboard box C so that the distance Z from the end part 61*a* of the shutter 61, on the downstream side in the direction E that the products are pushed in by the push-in mechanism 50, to the bottom lid B of the corrugated cardboard box C that faces the opening Op is 30% or more of the length L of the products in the direction E that the products are pushed in by the push-in mechanism 50.

In this implementation, immediately before the last row of products is pushed in, the entry amount of the shutter 61 is changed so that the distance Z between the end part 61*a* of the shutter 61 and the bottom lid B facing the opening Op is 30% or more of the product length L in the product push-in direction E. Therefore, damage to the bags A is readily prevented even during product compression before the pushing in of the last row of products during which the bags A are readily damaged.

More preferably, when the products in the corrugated cardboard box C are compressed before the last row of products of the plurality of rows is pushed in by the push-in mechanism 50, the entry amount changing unit 41*a* changes the amount by which the shutter 61 enters the corrugated cardboard box C so that the distance Z from the end part 61*a* of the shutter 61, on the downstream side in the direction E that the products are pushed in by the push-in mechanism 50, to the bottom lid B of the corrugated cardboard box C that faces the opening Op is 50% or more and less than 70% of the length L of the products in the direction E that the products are pushed in by the push-in mechanism 50. In this case, damage to the bags A is even more readily prevented.

The boxing apparatus 10 according to the present implementation packs three or more rows of the products into the corrugated cardboard box C. Specifically, the boxing apparatus 10 packs four rows of the products into the corrugated cardboard box C. The entry amount changing unit 41*a* changes the amount by which the shutter 61 enters the corrugated cardboard box C so that the entry amount X2 is less than the reference entry amount Xr. The entry amount X2 is an example of the first entry amount. The reference entry amount Xr is an example of the second entry amount. The entry amount X2 is the amount by which the shutter 61 enters the corrugated cardboard box C when the products in the corrugated cardboard box C are compressed before the push-in mechanism 50 pushes in the last row of the plurality of rows of products. The reference entry amount Xr is the average of the amounts by which the shutter 61 enters the corrugated cardboard box C when the products in the corrugated cardboard box C are compressed before the push-in mechanism 50 pushes in the second through second-to-last rows of the plurality of rows of products. In the present implementation, the reference entry amount Xr is equal to the entry amount X1 (the amount by which the shutter 61 enters the corrugated cardboard box C when the products in the corrugated cardboard box C are compressed before the push-in mechanism 50 pushes in the second and third rows of products).

In this implementation, the entry amount of the plate-shaped member during product compression immediately before the last row of products is pushed in (the entry amount X2) is less than the average of the entry amounts of the shutter 61 during the preceding product compressions (the reference entry amount Xr). Therefore, damage to the bags A is readily prevented even during product compression before the last row of products is pushed in, during which the bags A are readily damaged.

With this configuration, when the products are compressed at times other than before the last row of products is pushed in (before the second through second-to-last rows of products are pushed in), the products are readily compressed firmly by the shutter 61, and it is easy to improve product-filled rate.

In the boxing apparatus 10 according to the present implementation, the controller 41 further has the movement amount changing unit 41*b*. The movement amount changing unit 41*b* changes the relative movement amount between the corrugated cardboard box C and the shutter 61 caused by the vertical movement mechanism 33 when the products in the corrugated cardboard box C are compressed. The movement amount changing unit 41*b* changes the relative movement amount between the corrugated cardboard box C and the shutter 61 caused by the vertical movement mechanism 33 so that the movement amount Y2 is greater than the reference movement amount Yr. The movement amount Y2 is an example of the first relative movement amount. The reference movement amount Yr is an example of the second relative movement amount. The movement amount Y2 is the relative movement amount between the corrugated cardboard box C and the shutter 61 caused by the vertical movement mechanism 33 when the products in the corrugated cardboard box C are compressed before the push-in mechanism 50 pushes in the last row of the plurality of rows of products. The reference movement amount Yr is the average of the relative movement amounts between the corrugated cardboard box C and the shutter 61 caused by the vertical movement mechanism 33 when the products in the corrugated cardboard box C are compressed before the push-in mechanism 50 pushes in the second through second-to-last rows of the plurality of rows of products. In this implementation, the reference movement amount Yr is equal to the movement amount Y1 (the relative movement amount between the corrugated cardboard box C and the shutter 61 caused by the vertical movement mechanism 33 when the products in the corrugated cardboard box C are compressed before the push-in mechanism 50 pushes in the second and third rows of products).

Immediately before the last row of products is pushed into the corrugated cardboard box C, the corrugated cardboard box C has already been filled with a large number of products, product-filled rate is comparatively high, and it is therefore generally difficult to sufficiently ensure space for pushing the products into the corrugated cardboard box C.

In the present boxing apparatus 10, a particularly large relative movement amount between the corrugated cardboard box C and the shutter 61 can be achieved immediately before the last row of products is pushed into the corrugated cardboard box C, and it is therefore easy to ensure space to push in the products (space where the products pushed in by the push-in mechanism 50 enter the corrugated cardboard box C). With the present boxing apparatus 10, as the entry amount of the shutter 61 is suppressed to a small amount when the products are compressed immediately before the last row of products is pushed in, and damage to the bags A is readily prevented even when the relative movement amount between the corrugated cardboard box C and the shutter 61 is large.

The boxing apparatus 10 according to the present implementation includes the holding section 31 to hold the corrugated cardboard box C. The vertical movement mechanism 33 moves the holding section 31 up and down.

In this boxing apparatus 10, in order for a plurality of rows of products to be packed, the corrugated cardboard box C and the position where the products are pushed in by the push-in mechanism 50 are moved up and down relative to each other when the products are pushed in. Further, in this boxing apparatus 10, the corrugated cardboard box C and the shutter 61 are moved up and down relative to each other also in order to compress the products in the corrugated cardboard box C.

In the present boxing apparatus 10, the vertical movement mechanism 33 moves the holding section 31 for the corrugated cardboard box C (i.e., the corrugated cardboard box C) up and down. Therefore, the same vertical movement mechanism 33 can be utilized to move the product push-in position and the corrugated cardboard box C up and down relative to each other and to move the corrugated cardboard box C and the shutter 61 up and down relative to each other when the products are pushed in and when the products in the corrugated cardboard box C are compressed. The structure of the apparatus can therefore be made simpler than in cases in which both the product push-in position and the shutter 61 are moved.

(5) Modifications

Modifications of the present implementation are presented below. A plurality of modifications may be combined as appropriate so long as they do not contradict each other.

(5-1) Modification A

In the above implementation, the boxing apparatus 10, together with the box-making apparatus 2 and the box-closing apparatus 3, configure the box-making/boxing system 1, but this arrangement is not provided by way of limitation. The boxing apparatus 10 may be completely independent of the box-making apparatus 2 and the box-closing apparatus 3.

(5-2) Modification B

In the above implementation, the entry amount changing unit 41*a* changes the amount by which the shutter 61 enters the corrugated cardboard box C to the entry amount X1 before the first through third rows of products are pushed in, and to the entry amount X2 before the fourth row of products is pushed in, but this arrangement is not provided by way of limitation.

For example, the entry amount changing unit 41*a* may change the amount by which the shutter 61 enters the corrugated cardboard box C to be progressively smaller with higher rows, so that the entry amount before the first row of products is pushed in is greater than the entry amount before the second row of products is pushed in, which is greater than the entry amount before the third row of products is pushed in, which is greater than the entry amount before the fourth row of products is pushed in.

Additionally, for example, the entry amount changing unit 41*a* may change the amount by which the shutter 61 enters the corrugated cardboard box C to the entry amount X2 in the above implementation for all instances before the first through fourth rows of products are pushed in. Before the rows (the second and third rows) of products other than the highest row are pushed in, the amount by which the shutter 61 enters the corrugated cardboard box C is preferably set to a value comparatively larger than the value for before the highest row of products is pushed in, so that the bags A are compressed comparatively firmly between the shutter 61 and the corrugated cardboard box C.

(5-3) Modification C

In the above implementation, the corrugated cardboard box C is moved upward to compress the products in the corrugated cardboard box C between the shutter 61 and the corrugated cardboard box C, but this arrangement is not provided by way of limitation.

For example, the boxing apparatus 10 may be configured so that the shutter 61 can be moved up and down by a motor, an air cylinder, or another drive unit, and the products in the corrugated cardboard box C are compressed between the shutter 61 and the corrugated cardboard box C by moving the shutter 61 downward.

(5-4) Modification D

In the above implementation, the movement amount changing unit 41*b* changes the amount, by which the vertical movement mechanism 33 moves the corrugated cardboard box C relative to the shutter 61 when the products in the corrugated cardboard box C are compressed, to the movement amount Y1 before the second and third rows of products are pushed in, and to the movement amount Y2 before the fourth row of products is pushed in, but this arrangement is not provided by way of limitation.

For example, the movement amount changing unit 41*b* may change the amount, by which the vertical movement mechanism 33 moves the corrugated cardboard box C relative to the shutter 61 when the products in the corrugated cardboard box C are compressed, to be progressively greater with higher rows, so that the movement amount before the second row of products is pushed in is less than the movement amount before the third row of products is pushed in, which is less than the movement amount before the fourth row of products is pushed in.

Additionally, the controller 41 may not have the movement amount changing unit 41*b*, and the amount by which the vertical movement mechanism 33 moves the corrugated cardboard box C relative to the shutter 61 when the products in the corrugated cardboard box C are compressed may be always constant.

INDUSTRIAL APPLICABILITY

The boxing apparatus according to certain implementations of the present invention are useful as a boxing apparatus with which the product-filled rate inside the box is easily enhanced without damaging the products.

The invention claimed is:

1. A boxing apparatus configured to pack rows of products into a box, the products being packaged in a soft packaging material, the boxing apparatus comprising:

a pusher configured to repeatedly push the products into the box through a lateral opening of the box;

a plate-shaped member configured to enter and exit the box through the lateral opening, the plate-shaped member being separate from the pusher, the plate-shaped member further configured such that the products pushed in by the pusher move on an upper surface thereof;

a vertical movement mechanism configured to move the box up and down relative to the plate-shaped member;

a controller including a processor configured to execute a program to cause the plate-shaped member to enter the box, and to actuate the vertical movement mechanism to compress the products inside the box; and a storage configured to store the program, the controller having an entry amount changing unit that reduces an amount by which the plate-shaped member enters the box in a single action before compressing the products inside the box to a first entry amount smaller than a length of the box in a direction that the products are pushed in by the pusher, the controller being configured such that before the controller actuates the vertical movement mechanism to move the box to compress the products inside the box in a state where the plate-shaped member enters the box by the first entry amount, a gap is made between the box and the plate-shaped member so that a part of the soft packaging material spreads out through the gap into a space above the plate-shaped member, wherein at least before the products in the box are compressed so that a last row of products of the rows of products is pushed in by the pusher, the entry amount changing unit is configured to change the amount by which the plate-shaped member enters the box in the single action to the first entry amount which is equal to 70% or less of the length of the box in the direction that the products are pushed in by the pusher.

2. The boxing apparatus according to claim 1, wherein at least before the products in the box are compressed so that the last row of products of the rows of products is pushed in by the pusher, the entry amount changing unit is configured to change the amount by which the plate-shaped member enters the box in the single action to the first entry amount so that a distance from an end part of the plate-shaped member on a downstream side in the direction that the products are pushed in by the pusher to a wall of the box that faces the lateral opening is 30% or more of a length of the products in the direction that the products are pushed in by the pusher.

3. The boxing apparatus according to claim 1, wherein the boxing apparatus is configured to pack three or more rows of the products into the box, the first entry amount is an amount by which the plate-shaped member enters the box before compressing the products in the box so that the pusher pushes in the last row of the rows of products, and the entry amount changing unit is configured to change the amount by which the plate-shaped member enters the box so that the first entry amount is less than a second entry amount, which is an average of amounts by which the plate-shaped member enters the box before compressing the products in the box so that the pusher pushes in second through second-to-last rows of the rows of products.

4. The boxing apparatus according to claim 1, wherein the controller further has a movement amount changing unit configured to change a relative movement amount between the box and the plate-shaped member caused by the vertical movement mechanism before compressing the products in the box; and the movement amount changing unit is configured to change the relative movement amount between the box and the plate-shaped member caused by the vertical movement mechanism so that a first relative movement amount, which is a relative movement amount between the box and the plate-shaped member caused by the vertical movement mechanism before compressing the products in the box so that the pusher pushes in the last row of the rows of products, is greater than a second relative movement amount, which is an average of relative movement amounts between the box and the plate-shaped member caused by the vertical movement mechanism before compressing the products in the box so that the pusher pushes in second through second-to-last rows of the rows of products.

5. The boxing apparatus according to claim 1, further comprising a holding section configured to hold the box, wherein the vertical movement mechanism is configured to move the holding section up and down.

* * * * *